US009066842B2

(12) United States Patent
Partridge et al.

(10) Patent No.: US 9,066,842 B2
(45) Date of Patent: Jun. 30, 2015

(54) BODY ROTATION AND SECURING SLING AND METHODS OF USE

(71) Applicants: Sue Ann Partridge, Avondale Estates, GA (US); Laura Kim Porter, Buford, GA (US); Thomas Josh Porter, Buford, GA (US)

(72) Inventors: Sue Ann Partridge, Avondale Estates, GA (US); Laura Kim Porter, Buford, GA (US); Thomas Josh Porter, Buford, GA (US)

( * ) Notice: Subject to any disclaimer, the term of this patent is extended or adjusted under 35 U.S.C. 154(b) by 0 days.

(21) Appl. No.: 13/969,676

(22) Filed: Aug. 19, 2013

(65) Prior Publication Data

US 2015/0047120 A1 Feb. 19, 2015

(51) Int. Cl.

| | |
|---|---|
| ***A61G 7/10*** | (2006.01) |
| ***A61G 7/14*** | (2006.01) |
| *A61G 7/00* | (2006.01) |
| *A47C 21/02* | (2006.01) |

(52) U.S. Cl.

CPC ..... *A61G 7/1026* (2013.01); *A61G 7/001* (2013.01); *A47C 21/022* (2013.01); *A61G 7/1051* (2013.01)

(58) Field of Classification Search

CPC ... A61G 7/1023; A61G 7/1026; A61G 7/001; A61G 7/10; A61G 1/01; A61G 1/00; A61G 1/048; A61G 7/1025; A61G 7/1038; A61G 7/1051; A47G 9/04; A47C 21/022

USPC ..... 5/81.1 R, 81.1 T, 88.1, 84.1, 89.1, 5/81.1 HS, 625

See application file for complete search history.

(56) References Cited

U.S. PATENT DOCUMENTS

| | | | | |
|---|---|---|---|---|
| 3,302,219 | A | 2/1967 | Harris | |
| 3,597,774 | A * | 8/1971 | Warren | 5/84.1 |
| 4,970,739 | A * | 11/1990 | Bradford | 5/625 |
| 5,005,231 | A * | 4/1991 | Lonardo | 5/81.1 T |
| 5,329,655 | A * | 7/1994 | Garner | 5/81.1 T |
| 5,544,371 | A | 8/1996 | Fuller | |
| 5,673,443 | A | 10/1997 | Marmor | |
| 5,920,929 | A * | 7/1999 | Hensley et al. | 5/81.1 T |
| 6,196,229 | B1 * | 3/2001 | Piazza | 128/869 |
| 6,477,728 | B1 * | 11/2002 | Faz | 5/625 |
| 6,560,793 | B2 * | 5/2003 | Walker | 5/81.1 T |
| 6,772,456 | B2 | 8/2004 | Votel | |
| 7,552,493 | B2 * | 6/2009 | McNulty | 5/723 |
| 7,818,836 | B2 * | 10/2010 | Stinson | 5/487 |
| 7,945,975 | B2 * | 5/2011 | Thomas et al. | 5/81.1 T |
| 8,590,077 | B2 * | 11/2013 | Saunders et al. | 5/628 |
| 8,677,530 | B2 * | 3/2014 | Calkin | 5/628 |
| 8,789,533 | B2 * | 7/2014 | Steffens et al. | 128/845 |
| 2005/0103350 | A1 * | 5/2005 | Henry | 128/869 |
| 2006/0185078 | A1 * | 8/2006 | Perry | 5/81.1 T |
| 2008/0209630 | A1 * | 9/2008 | Kazala et al. | 5/81.1 T |
| 2012/0186012 | A1 * | 7/2012 | Ponsi et al. | 5/81.1 R |
| 2013/0227789 | A1 * | 9/2013 | Olson et al. | 5/625 |

* cited by examiner

*Primary Examiner* — Nicholas Polito
*Assistant Examiner* — David R Hare
(74) *Attorney, Agent, or Firm* — Mathew L. Grell; Balser & Grell IP Law, LLC

(57) ABSTRACT

A body rotation and securing sling having a flat sheet configured with a plurality of edges dimensioned to accommodate a side laying person's back, torso, hips and upper legs, wherein at least two edges are angled, curved, or slanted to transition between other sets of edges, a plurality of straps configured to reposition and secure the side laying person and, thus to enable a service personnel to reposition a bed ridden person by tugging or pulling on the straps to reposition and roll the laying patient from side-to-side and to secure the side laying person on one side or angled side until time for rotation to the other side.

22 Claims, 18 Drawing Sheets

BODY ROTATION AND SECURING SLING AND METHODS OF USE

TECHNICAL FIELD

The disclosure relates generally to rotation from side-to-side and securing a bed bound patient and more specifically it relates to a sling for turning from side-to-side and securing on one of their sides a bed bound patient.

BACKGROUND

The need to turn from side-to-side and secure a person confined to a bed with temporary or permanent loss of mobility is well known. Patient rotation from side-to-side is necessary for maintaining patient comfort, facilitating examination, and preventing bed sores from forming. Manual lifting and turning of a bed ridden patient is physically demanding for nurses, aides and others responsible for the care of the bed ridden patient. Such labor may result in injury to the back and other body parts of the person doing the lifting and/or turning of the patient. These injuries to nurses, aides and others result in time lost from the job and increased health care costs. Most medical personnel who are trained to care for bed ridden patients use a small draw sheet or plastic backed absorbent upon which a patient is rolled or rests to assist in turning the patient. By pulling on one side of the small draw sheet or plastic backed absorbent, the nurse or aide (typically two persons) can facilitate positioning the bed ridden patient in the correct position on the bed. Next, to turn the bed ridden patient on their other side two nurses or aides will roll the patient in the opposite direction and utilize a draw sheet to reposition the bed ridden patient in the center of the bed on the patient's other side. The act of pulling on the patient with a draw sheet is strenuous on the fingers, hands, and wrists of the care giver, especially when the patient is heavy.

Various sheets and slings are known in the prior art, for example, there are flat and fitted sheets for beds, reusable grocery bags having two looped support straps, and slings for special purposes, such as to transport a sick or injured person having handles or loop straps. Slings for special purposes and reusable grocery bags are constructed of fabric such as canvas, woven synthetic fibers, or a thick plastic and have handles or loop straps to assist with lifting and transporting.

Moreover, a variety of bed ridden patient apparatus or systems exist for lifting, transporting, and turning a bed ridden patient. Most such bed ridden patient apparatus or systems include a flat rectangular sheet, which extends beyond the length and width of the patient, having long straps attached to the sheet that feed into mechanical means for lifting and turning, such as mechanical rollers supported by a stationary or moveable support structure positioned above a hospital bed. Alternatively lift platforms integrated into the bed have been utilized to raise, reposition, and turn bed ridden patients.

Typically, space is limited in hospital and assisted care rooms. Therefore, devices to assist with patient rollovers must occupy a minimum amount of space (if kept in the room). Moreover, the elimination of the capital expenditures for large structured mechanical lifting, transporting, and turning systems could help offset the rising cost of healthcare.

Therefore, it is readily apparent that there is a recognized unmet need for a body rotation and securing sling and methods of use, wherein such apparatus is small in size, disposable, and safely enables two directional rotating and the securing of a bed ridden patient in a comfortable angled back leaning side to side position.

BRIEF SUMMARY

Briefly described, in an example embodiment, the present apparatus and method overcomes the above-mentioned disadvantage, and meets the recognized need for a body rotation and securing sling and methods of use comprising, in general, a flat sling or sheet configured with a plurality of edges dimensioned to accommodate a side laying person's back, torso, hips and upper legs, wherein at least two edges are angled, curved, or slanted to adjoin other sets of edges, a plurality of straps configured to reposition and secure the side laying person and, thus to enable a service personnel to reposition a bed ridden person by tugging or pulling on the straps to reposition and roll the laying patient from side-to-side and to secure the side laying person on one side until time for rotation to the other side.

In a preferred embodiment, a body rotation and securing sling and methods of use, the apparatus including a contoured sheet configured with a plurality of edges dimensioned to conform to the side laying person, a plurality of straps having a first end and a second end, the plurality of straps configured with the second end of each of the plurality of straps affixed thereto an edge of the plurality of edges, and wherein the first end of each of the plurality of straps is configured having an attachment mechanism thereon.

In still a further exemplary embodiment of the method of positioning, rolling, and securing a side laying person on a bed having a rail, the method including the steps of providing a body rotation and securing apparatus, the apparatus having a contoured sheet configured with a plurality of edges dimensioned to conform to the side laying person, a plurality of straps having a first end and a second end, the plurality of straps configured with the second end of each of the plurality of straps affixed thereto an edge of the plurality of edges, wherein the first end of each of the plurality of straps is configured having an attachment mechanism thereon, positioning the apparatus on the bed, laying the patient on the apparatus with the apparatus positioned between the patient and the bed, and pulling on the plurality of straps to reposition the patient on the bed.

Accordingly, a feature of the body rotation and securing sling and methods of use is its ability to enable a single person to comfortably maneuver, reposition, and roll a bed ridden patient from side-to-side and to center them in the bed by pulling on the straps positioned on both sides of the sling when the sling is positioned under the bed ridden patient.

Another feature of the body rotation and securing sling and methods of use is its ability to provide efficient and safe apparatus for rolling and repositioning of bed ridden patients.

Still another feature of the body rotation and securing sling and methods of use is its ability to enable a single person to quickly and/or efficiently secure a bed ridden patient on either of the patient's sides to maintain patient comfort, facilitate patient examination, and to prevent bed sores from forming.

Yet another feature of the body rotation and securing sling and methods of use is its ability to provide a compact, foldable, and portable sling that is easily stored and transported to the patient's room.

Yet another feature of the body rotation and securing sling and methods of use is its ability to assist with bed ridden patient rolling, positioning, repositioning, and tilting a bed ridden patient from side-to-side.

Yet another feature of the body rotation and securing sling and methods of use is its ability to relieve stress on the fingers, hands, and wrists of the care giver, especially when the patient is heavy.

Yet another feature of the body rotation and securing sling and methods of use is its ability to accommodate different sized bed ridden patients.

Yet another feature of the body rotation and securing sling and methods of use is its ability to conform to a side laying patient's back, torso, hips, and upper legs.

Yet another feature of the body rotation and securing sling and methods of use is its ability to provide a low cost alternative to systems for lifting, transporting, and turning a bed ridden patient, such as, mechanical means for lifting and turning, including mechanical rollers supported by a stationary or moveable support structure positioned above a hospital bed.

Yet another feature of the body rotation and securing sling and methods of use is its ability to provide a support assembly capable of supporting a bed ridden patient in an angled position on their side to enable additional positions to rest on their side to reduce bed sores and to increase comfort of the bed ridden patient.

Yet another feature of the body rotation and securing sling and methods of use is its ability to be utilized with existing beds or bed frames.

Yet another feature of the body rotation and securing sling and methods of use is its ability to be easier, less expensive, and simpler to use than existing technology.

These and other features of the body rotation and securing sling and methods of use will become more apparent to one skilled in the art from the following Detailed Description of the Embodiments and Claims when read in light of the accompanying drawing Figures.

BRIEF DESCRIPTION OF THE DRAWINGS

The present body rotation and securing sling and methods of use will be better understood by reading the Detailed Description of the embodiments with reference to the accompanying drawing figures, in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed invention.

DETAILED DESCRIPTION

In describing the exemplary embodiments of the present disclosure, as illustrated in FIGS. 1-16 specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Figure 1:
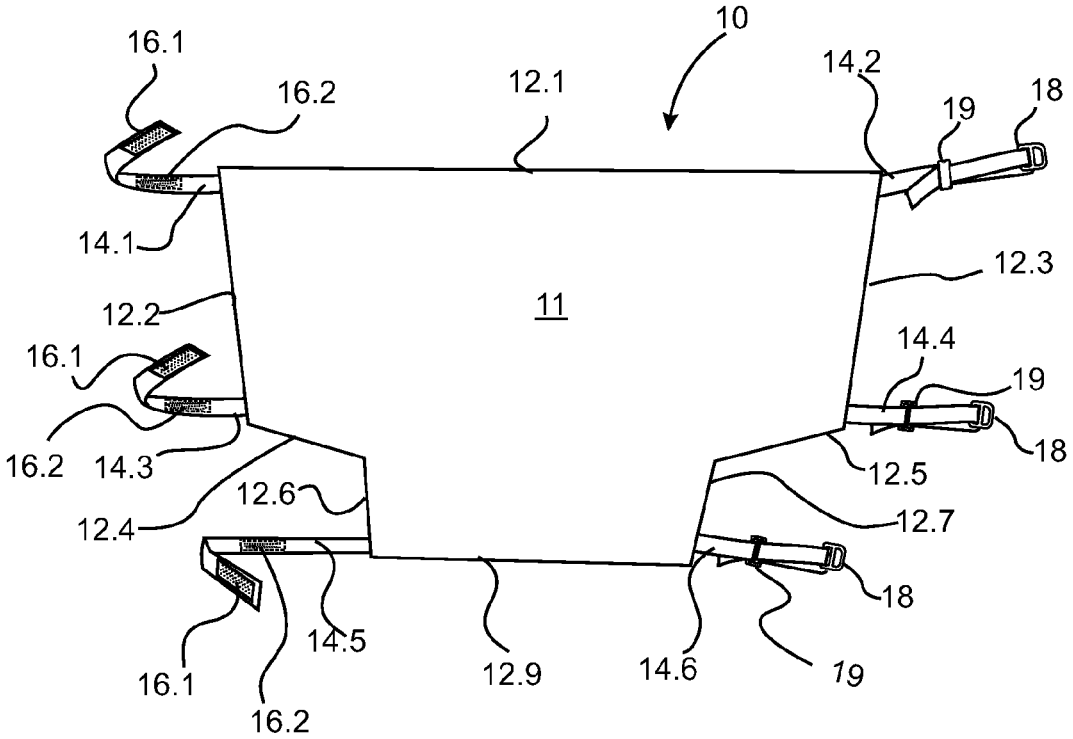
FIG. 1 is a perspective view of an example embodiment of body rotation and securing sling assembly.

Referring now to FIG. 1, by way of example, and not limitation, there is illustrated exemplary embodiment of body rotation and securing assembly, such as sling assembly 10. Preferably, sling assembly 10 includes a contoured surface, sheet, or carrier base, such as sling 11, configured with a plurality of edges 12 dimensioned to accommodate a side laying person or patient's P back B, torso T, hips H and upper legs UL. Edges 12 may preferably include top edge 12.1, bottom edge 12.9, first torso edge 12.2, second torso edge 12.3, first hip edge 12.4, second hip edge 12.5, first leg edge 12.6, and second leg edge 12.7. Preferably, top edge 12.1 and bottom edge 12.9, first torso edge 12.2 and second torso edge 12.3, first hip edge 12.4 and second hip edge 12.5, first leg edge 12.6 and second leg edge 12.7, are configured so that when folded such sets of edges are configured as approximately parallel (parallel) to one another. Furthermore, first hip edge 12.4 and second hip edge 12.5 are preferably angled, curved, tapered, arced, or slanted, such as first and second angled transition relative to first torso edge 12.2 and first leg edge 12.6, and second torso edge 12.3 and second leg edge 12.7, respectively, to accommodate the difference in size and/or volume between torso T, hips H and upper legs U of the bed ridden patient P. Still further, first hip edge 12.4 transitions (at an angle) between edges, such as first torso edge 12.2 and first leg edge 12.6 and second hip edge 12.5 transitions (at an angle) between edges second torso edge 12.3 and second leg edge 12.7 to conform to a side laying patient P with bent knees. Moreover, first torso edge 12.2 and second torso edge 12.3 preferably run parallel to first leg edge 12.6 and second leg edge 12.7.

It is contemplated herein that edge 12 configurations and subsection areas of sling 11 may vary in configuration provided patient's P back B, torso T, hips H and upper legs UL are each supported by sling 11 and patient P is supported in a fetal or with upper legs UL angled from torso T while on their side.

It is contemplated herein that edge 12 configurations and subsection areas of sling 11 are configured to partially wrap or envelope around at least the underside, backside, and top side of side laying patient P.

Preferably sling 11 includes a plurality of belts, leashes, carrying or lift devices, such as one or more straps 14 joined, bonded, sewn, or otherwise affixed on one end (second end) of straps 14 thereto edge 12 of sling 11. Straps 14 may preferably include shoulder straps, such as first torso strap 14.1, second torso strap 14.2, center straps, such as first hip strap 14.3, second hip strap 14.4, leg straps such as, first leg strap 14.5, and second leg strap 14.6. Straps 14 preferably are positioned approximately parallel to top edge 12.1 and bottom edge 12.9. Matching pairs of straps 14 are preferably positioned proximate first torso edge 12.2 and second torso edge 12.3, and proximate first leg edge 12.6 and second leg edge 12.7. Matching pairs of straps 14 are preferably configured to enclose sling 11 around bed ridden patient P and releasably secure patient P on patient's P side. Straps 14 positioned on the same side of sling 11, such as on one side of sling 11, including first torso strap 14.1, first hip strap 14.3, and first leg strap 14.5, as well as on the other side of sling 11, including second torso strap 14.2, second hip strap 14.4, and second leg strap 14.6 are preferably configured to assist a nurse, aide, care giver, or other service person SP responsible for the care of the bed ridden patient or patient P, such as to tug or pull on straps 14 to reposition, slide, and/or roll laying patient P from side-to-side, to center the patient P on the bed, and/or to releasably secure the side laying person on one side until time for rotation to the patient's other side.

Straps 14, on one side of sling 11, such as first torso strap 14.1, first hip strap 14.3, and first leg strap 14.5 preferably include an attachment or coupling mechanism or system or device capable of securing a strap(s), such as hook 16.1 and loop 16.2 sections, capable of looping or folding back on itself to affix one section 16.1 of strap to another section 16.2, such as hook 16.1 and loop 16.2. Straps 14, on the other side of sling 11, such as second torso strap 14.2, second hip strap 14.4, and/or second leg strap 14.6 preferably include a strap mechanism or device or adjustment ring, such as buckle 19 wherein strap 14 is preferably fitted through buckle 19 and looped through attachment ring, such as S or D ring 18 and then back through buckle 19. Preferably buckle 19 is configured to enable linear length adjustment of second torso strap 14.2, second hip strap 14.4, and/or second leg strap 14.6 to accommodate size differences and/or volume of torso T, hips H and upper legs U of the bed ridden patient P.

Figure 2:
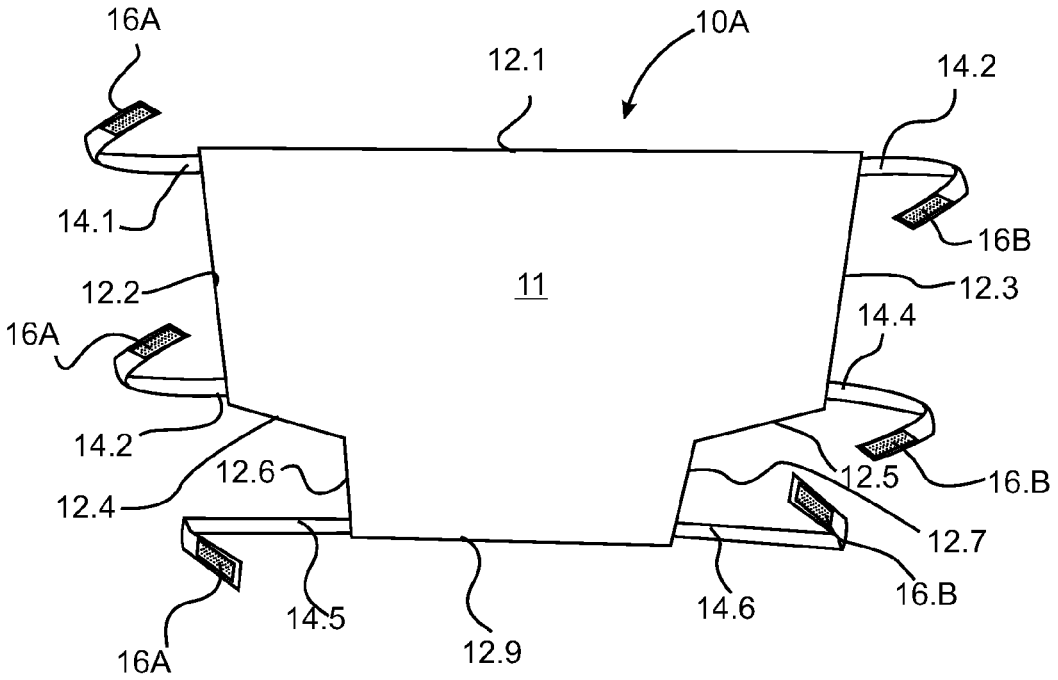
FIG. 2 is a perspective view of an alternate example embodiment of body rotation and securing sling assembly of FIG. 1.

Referring now to FIG. 2, by way of example, and not limitation, there is illustrated alternate embodiment of sling assembly 10, shown as sling assembly 10A. Preferably, sling assembly 10A includes straps 14, on one side of sling 11, such as first torso strap 14.1, first hip strap 14.3, and first leg strap 14.5, which include an attachment mechanism or device, peel and stick, hook and loop, and the like capable of securing strap(s) 14 to each other, such as hook 16A or loop 16B section capable of affixing to a matching hook or loop section on another strap 14. Straps 14, on the other side of sling 11, such as second torso strap 14.2, second hip strap 14.4, and/or second leg strap 14.6 preferably include an attachment or coupling mechanism or device capable of securing a strap(s), such as hook 16A or loop 16B section capable of affixing to a matching hook or loop section on another strap 14.

Sling assembly 10/10A, sling 11, and straps 14 are preferably formed of a suitable material or fabric, such as duck cloth with a brushed twill lining, or vinyl, canvas, plastic, rubber, polyurethane, fiber, coated fiber or mesh, nylon, Tyvek, or the like, capable of providing structure to sling assembly 10/10A. Preferably, the material includes other suitable characteristics, such as flexibility, durability, strength, water resistant, seal fluids therein, puncture resistant, tear resistant, rust-resistance, light weight, heat-resistance, chemical inertness, oxidation resistance, ease of workability, or other beneficial characteristic understood by one skilled in the art.

It is further contemplated herein that sling 11 may be configured and/or sized to accommodate various sized patients P to be secured therein.

It is further contemplated herein that sling assembly 10/10A may be designed for single disposable use or reuseable for multiple uses.

It is still further contemplated herein that sling assembly 10/10A provides a compact, foldable, and portable sling assembly 10/10A that is easily stored and transported to the patient's room.

Figure 3:
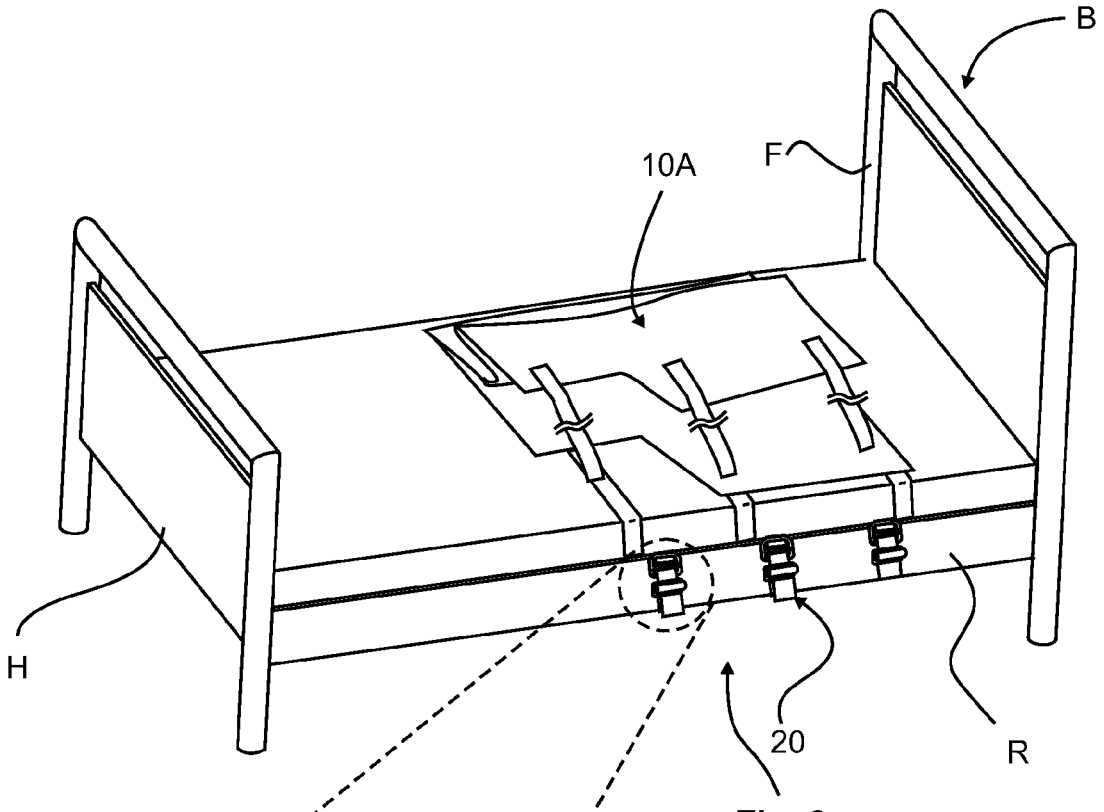
FIG. 3 is a side perspective view of a hospital bed with body rotation and securing sling assembly of FIG. 1 or 2.
Figure 3A:
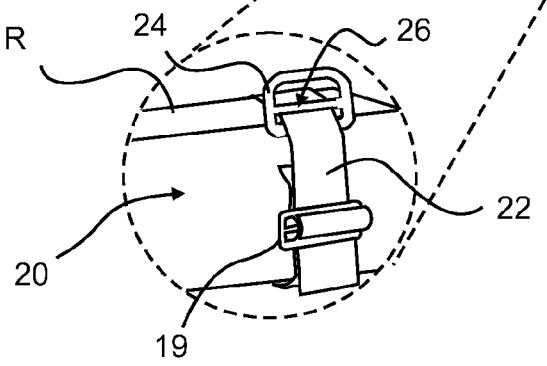
FIG. 3A is an exploded view of a hospital bed with body an anchor strap configured to loop around a rail of a bed to create an anchor point for body rotation and securing sling assembly of FIG. 1 or 2.

Referring now to FIG. 3, by way of example, and not limitation, there is illustrated exemplary hospital bed or other bed B. It is contemplated herein that bed B may include object(s) or articles utilized to position or carrier, whether temporarily or for some duration, a person while laying down on their back or side. Preferably bed B includes frame F for vertical support and one or more rails R for lateral support. Moreover, sling assembly 10/10A, sling 11, and straps 14 are shown positioned thereon bed B ready for use. Referring now to FIG. 3A, sling assembly 10/10A preferably includes frame anchoring device (FAS), such as anchor strap 20 configured to loop around rail R and cinch thereto to create an anchor to affix straps 14 thereto. Anchor strap 20 preferably includes loop strap 22, adjustment ring 19, and attachment ring, such as S or D ring, such second D ring 24. Preferably adjustment ring 19 is utilized to cinch or constrict anchor strap 20 around rail R to create an anchor point, such as second D ring 24 for straps 14 to fasten, insert, or affix thereto. In use, straps 14 of sling assembly 10/10A may be inserted through hook or aperture 26 of second D ring 24 affixed thereto rail R of bed B and utilized to anchor or affix sling assembly 10/10A to one side of bed B. Moreover, straps 14 of sling assembly 10/10A may be looped around rail R and utilized to cinch or constrict around rail R to create one or more anchor points for sling assembly 10/10A, thereto rail R.

It is contemplated herein that the preferred or alternate embodiment to affix sling assembly 10/10A to bed B may be utilized herein or any other known to one of ordinary skill in the art.

It is further contemplated herein that the preferred or alternate embodiment to affix sling assembly 10/10A to bed B may be to affix sling assembly 10/10A to bed B having one or more lift straps or handles affixed to the side of bed B.

Figure 4:
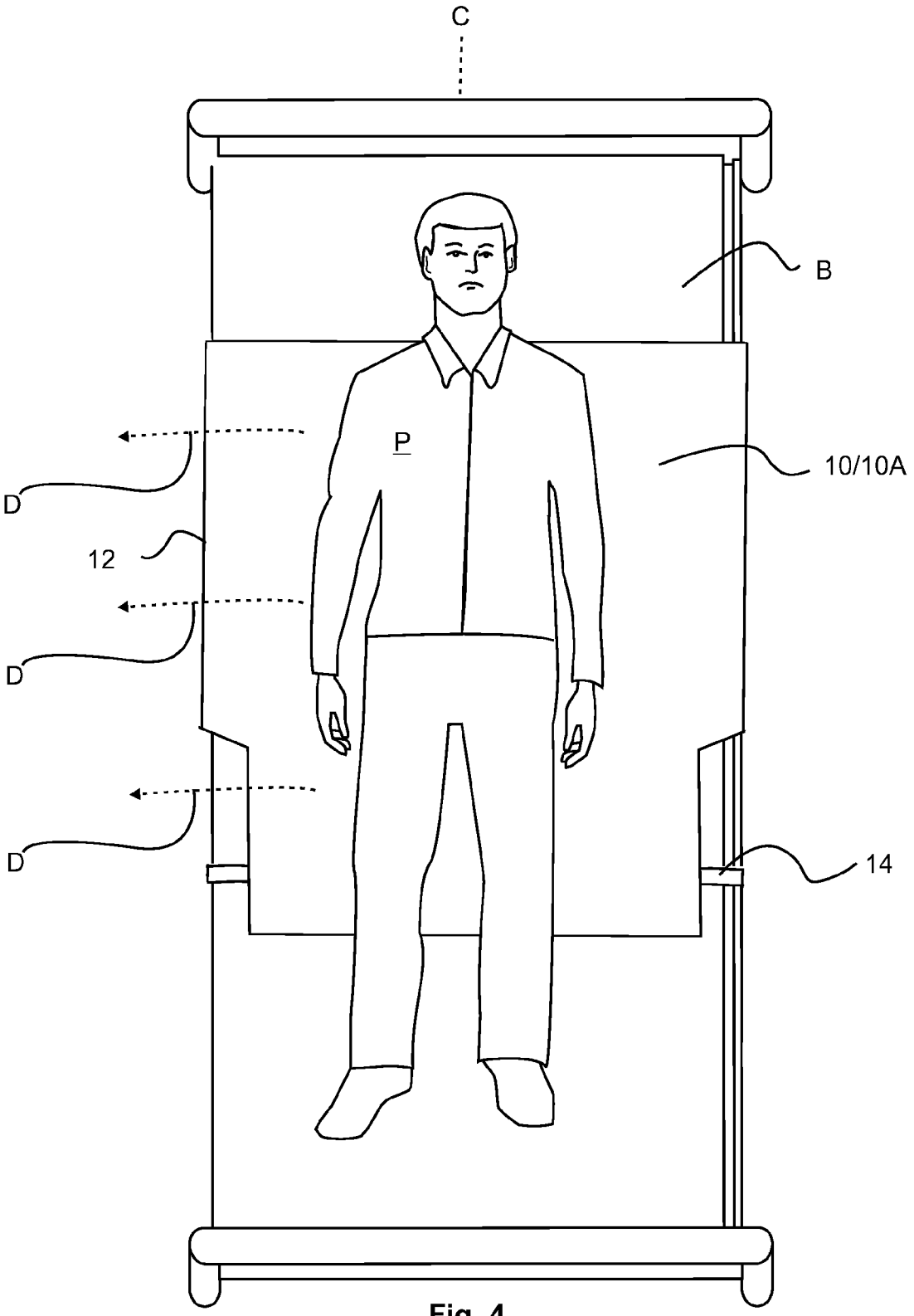
FIG. 4 is a top view of body rotation and securing sling assembly of FIGS. 1 and 2 positioned under a patient lying on a bed with the sling positioned on top of the bed between the patient and bed.
Figure 5:
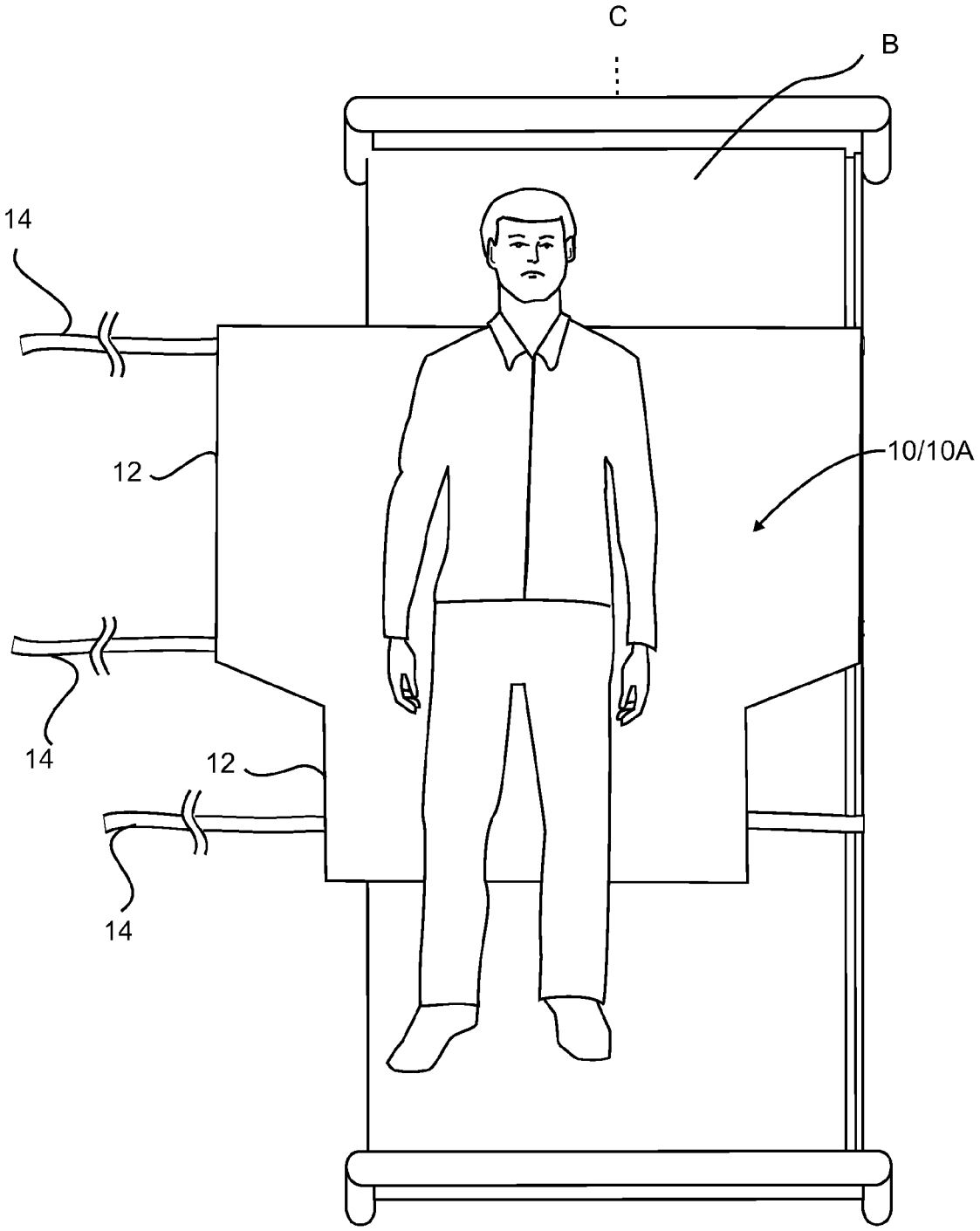
FIG. 5 is a top view of body rotation and securing sling assembly of FIGS. 1 and 2 positioned under a patient lying on a bed with the patient reposition left of the center line.

Referring now to FIGS. 4 and 5, by way of example, and not limitation, there is illustrated an exemplary view of sling assembly 10/10A positioned under a patient P lying on bed B with sling assembly 10/10A positioned on top of bed B between the patient P and bed B. As shown in FIG. 4, patient P may be positioned at rest and centered in bed B. Preferably edge 12 and/or straps 14 of sling assembly 10/10A may be utilized to drag, reposition, and/or move patient P around on bed B, in the direction D away from the center C line of bed B. As shown in FIG. 5, patient P may be drug or repositioned to one side (left of center C) of bed B by service person SP tugging or pulling on edge 12 and/or straps 14.

It is contemplated herein that sling assembly 10/10A preferably enables relief of stress on the fingers, hands, and wrists of the service person SP by providing straps 14 for the service person SP to grip for dragging, centering, and repositioning patient P, especially when the patient P is heavy. Moreover, sling assembly 10/10A relieves stress on the fingers, hands, and wrists of the service person SP, especially when the patient P is heavy.

It is further contemplated herein that sling assembly 10/10A preferably enables a single service person SP to comfortably maneuver, reposition, and roll a bed ridden patient from side-to-side and to center C them in bed B by pulling on straps 14 positioned on both sides of sling assembly 10/10A when sling assembly 10/10A is positioned under the bed ridden patient P.

It is further contemplated herein that sling assembly 10/10A preferably accommodates different sized bed ridden patients P to conform to a side laying patient's back, torso, hips, and upper legs.

Figure 6:
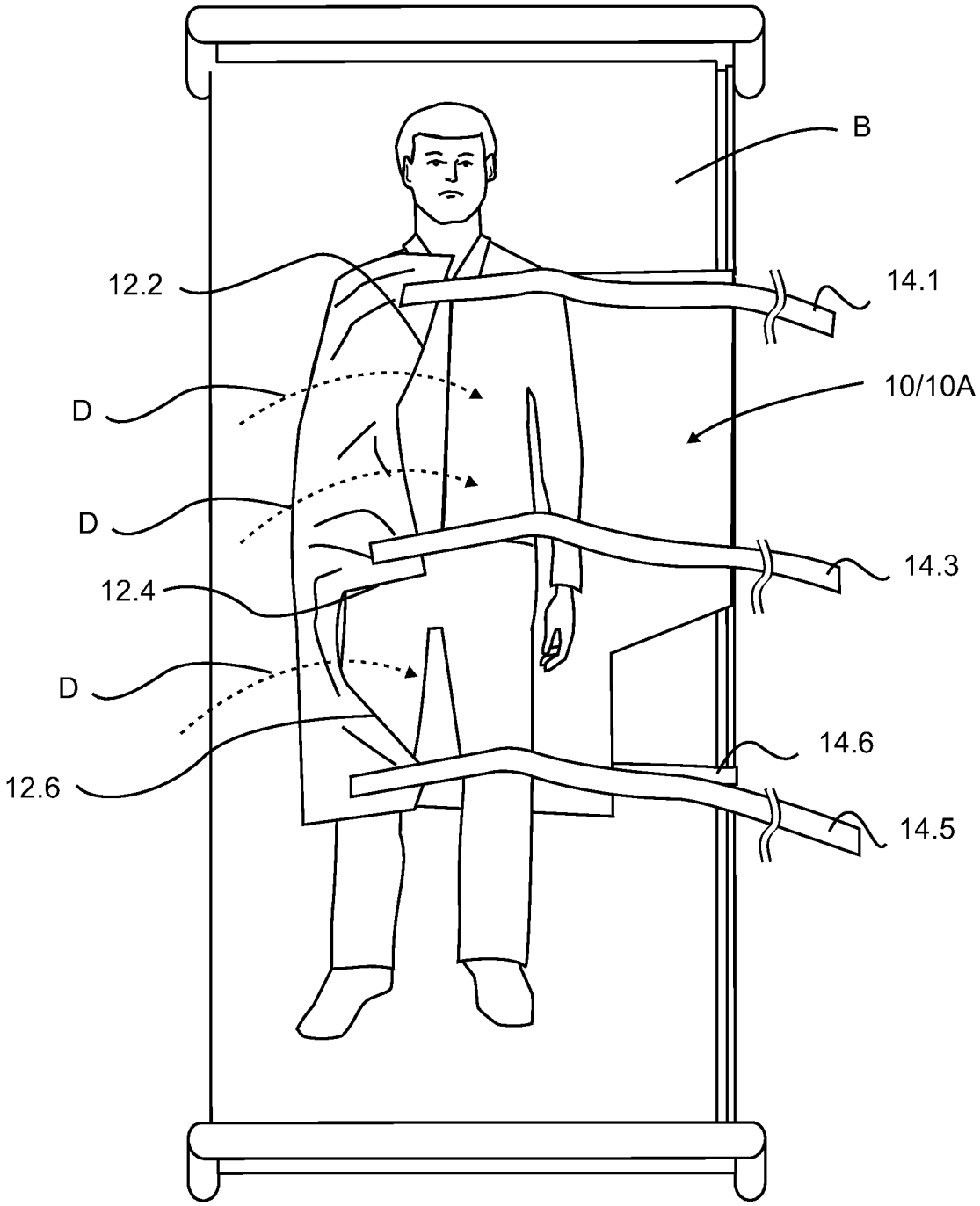
FIG. 6 is a top view of body rotation and securing sling assembly of FIGS. 1 and 2 positioned under a patient lying on a bed with a portion of the sling draped over the patient.
Figure 7:
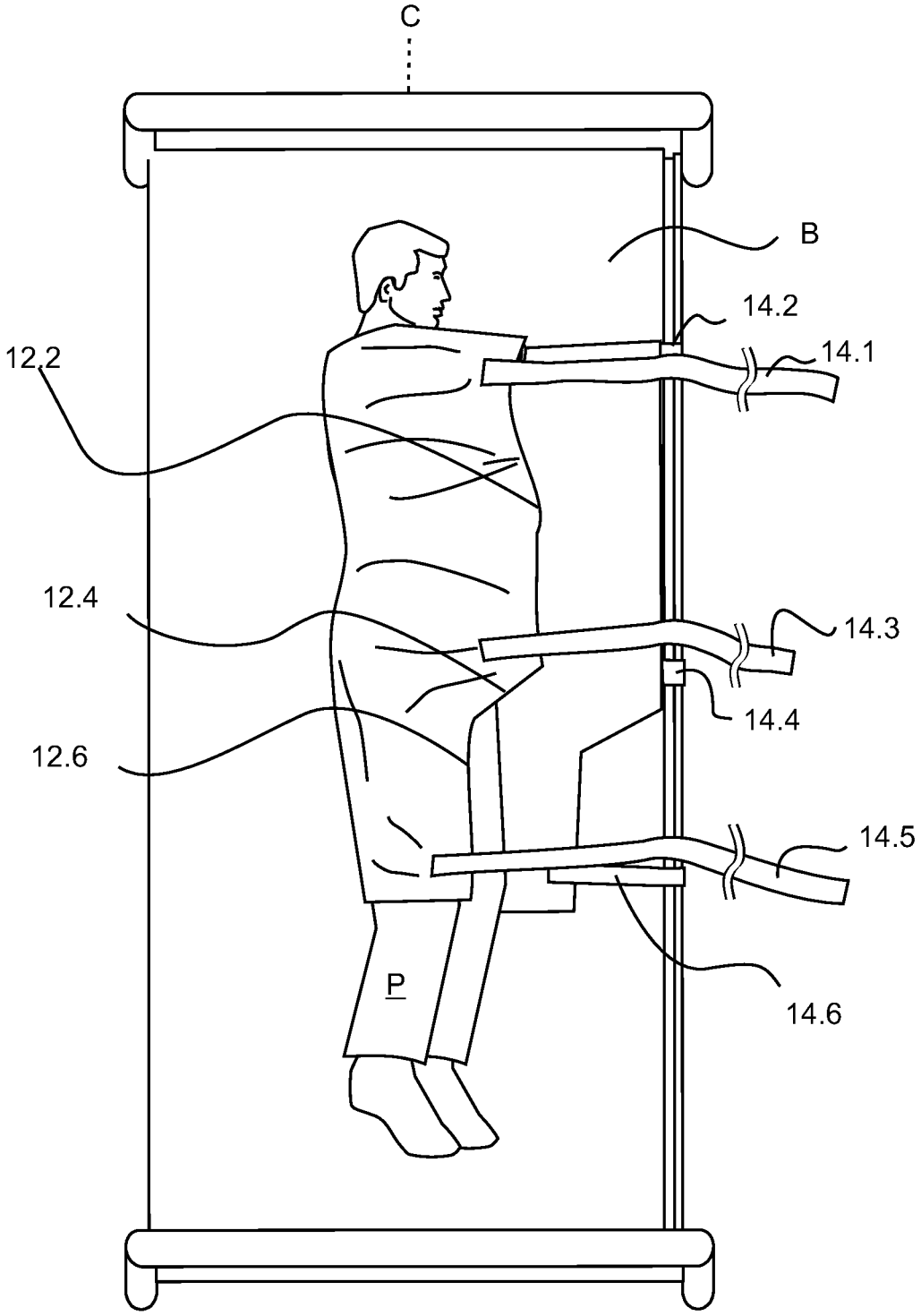
FIG. 7 is a top view of body rotation and securing sling assembly of FIGS. 1 and 2 positioned under a patient lying on a bed wherein the patient may be rolled or rotated in the direction D (shown in FIG. 6) to one side to a resting position on patient's left side.
Figure 8A:
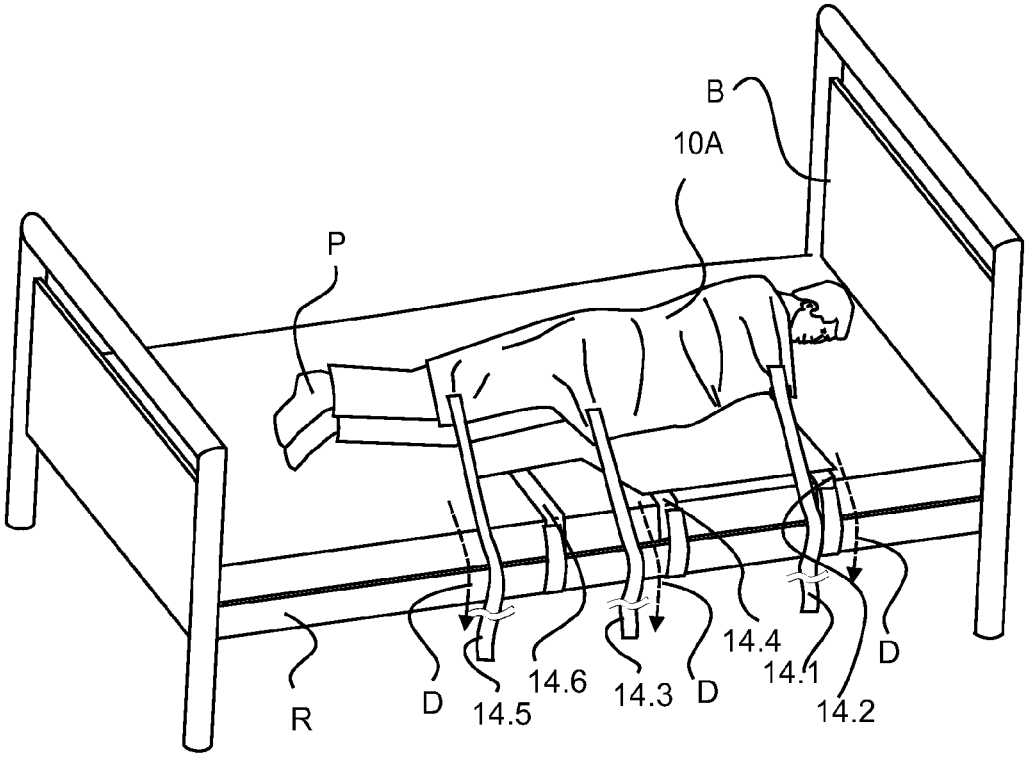
FIGS. 8A, 8B, 8C, and 8D are perspective side views of body rotation and securing sling assembly of FIG. 2 positioned under a patient lying on a bed wherein the patient, showing straps being fed around bed rail affixed to one another.
Figure 8B:
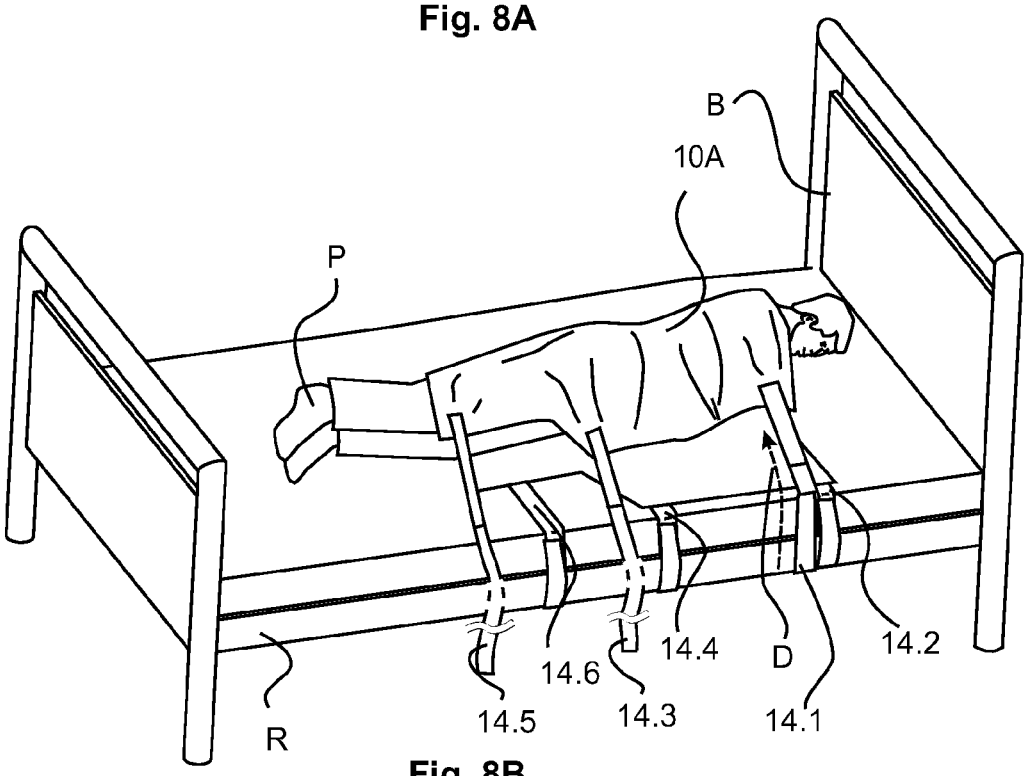
Figure 8C:
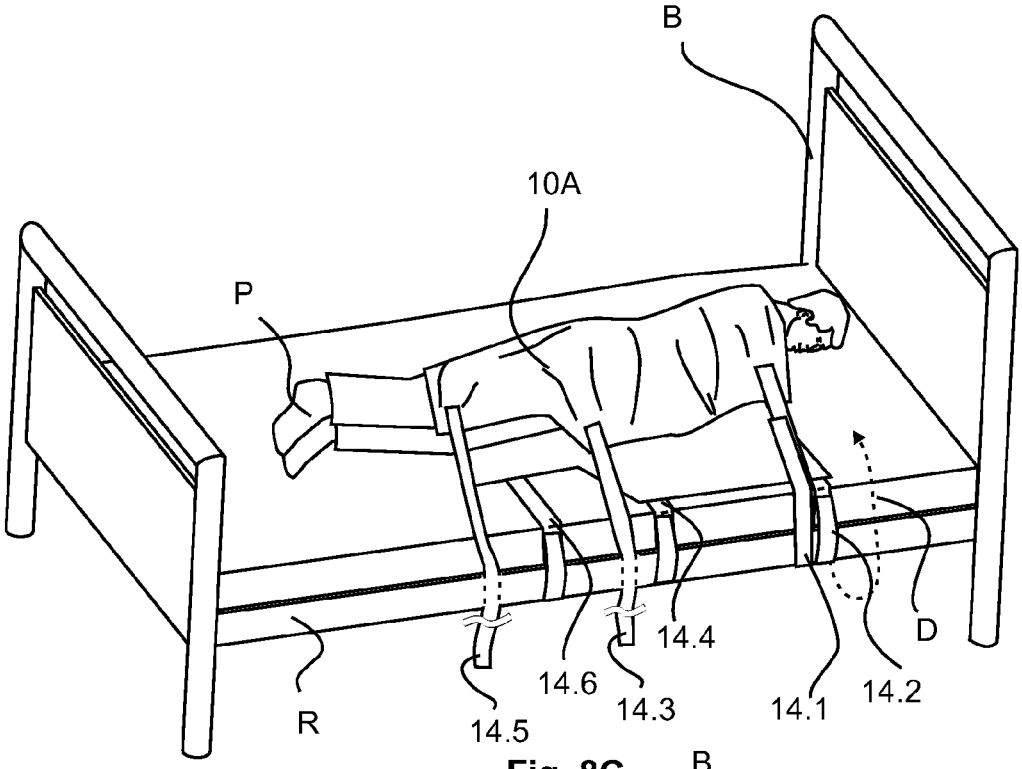
Figure 8D:
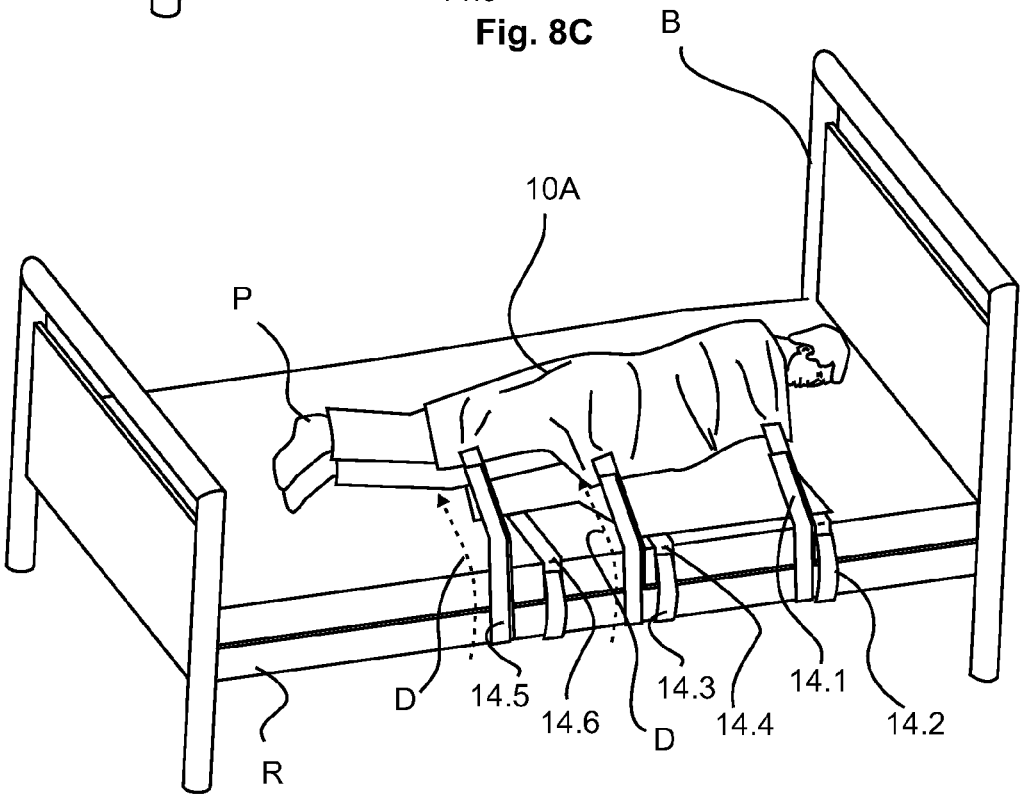

Referring now to FIGS. 6 and 7, by way of example, and not limitation, there is illustrated an exemplary view of sling assembly 10/10A positioned under patient P lying on a bed B with a portion of sling assembly 10/10A draped over patient P. Preferably, first torso strap 14.1, first hip strap 14.3, and first leg strap 14.5; first torso edge 12.2, first hip edge 12.4, and first leg edge 12.6 are draped over back lying patient P with first torso strap 14.1, first hip strap 14.3, and first leg strap 14.5 being disposed proximate second torso strap 14.2, second hip strap 14.4, and/or second leg strap 14.6 (shown in FIG. 7). As shown in FIG. 7, patient P may be rolled or rotated in the direction D (shown in FIG. 6) to one side to a resting position on patient's side (left side) by service person SP tugging or pulling on edge 12 and/or straps 14, especially tugging or pulling on first torso strap 14.1, first hip strap 14.3, and first leg strap 14.5; and/or first torso edge 12.2, first hip edge 12.4, and first leg edge 12.6 of sling assembly 10/10A.

It is contemplated herein that sling assembly 10/10A preferably assist service person SP by providing straps 14 for the service person SP to roll, position, reposition, center, and tilt a bed ridden patient P from side-to-side, especially when the patient P is heavy.

Referring now to 8A, 8B, 8C, and 8D, by way of example, and not limitation, there is illustrated views of sling assembly 10A positioned under patient P lying on a bed B with a portion of sling assembly 10A draped over patient P. Preferably first torso strap 14.1, first hip strap 14.3, and first leg strap 14.5 may be utilized to tug or pull patient P in the direction D to one side to a resting position on patient's side (left). Next, first torso strap 14.1, first hip strap 14.3, and first leg strap 14.5 and torso strap 14.2, second hip strap 14.4, and/or second leg strap 14.6 having hook 16.1 and loop 16.2 may be looped around rail R of bed B to releasably secure patient P in a resting position on patient's side (left). Alternatively, second torso strap 14.2, second hip strap 14.4, and/or second leg strap 14.6 may be fed under rail R of bed B and looped back up on to bed B. Corresponding hook and loop straps 14 may be releasably secured one to the other, such as first torso strap 14.1 and second torso strap 14.2, first hip strap 14.3 and second hip strap 14.4, and first leg strap 14.5 and second leg strap 14.6 to releasably secure patient P in a resting position on patient's side (left).

Figure 9A:
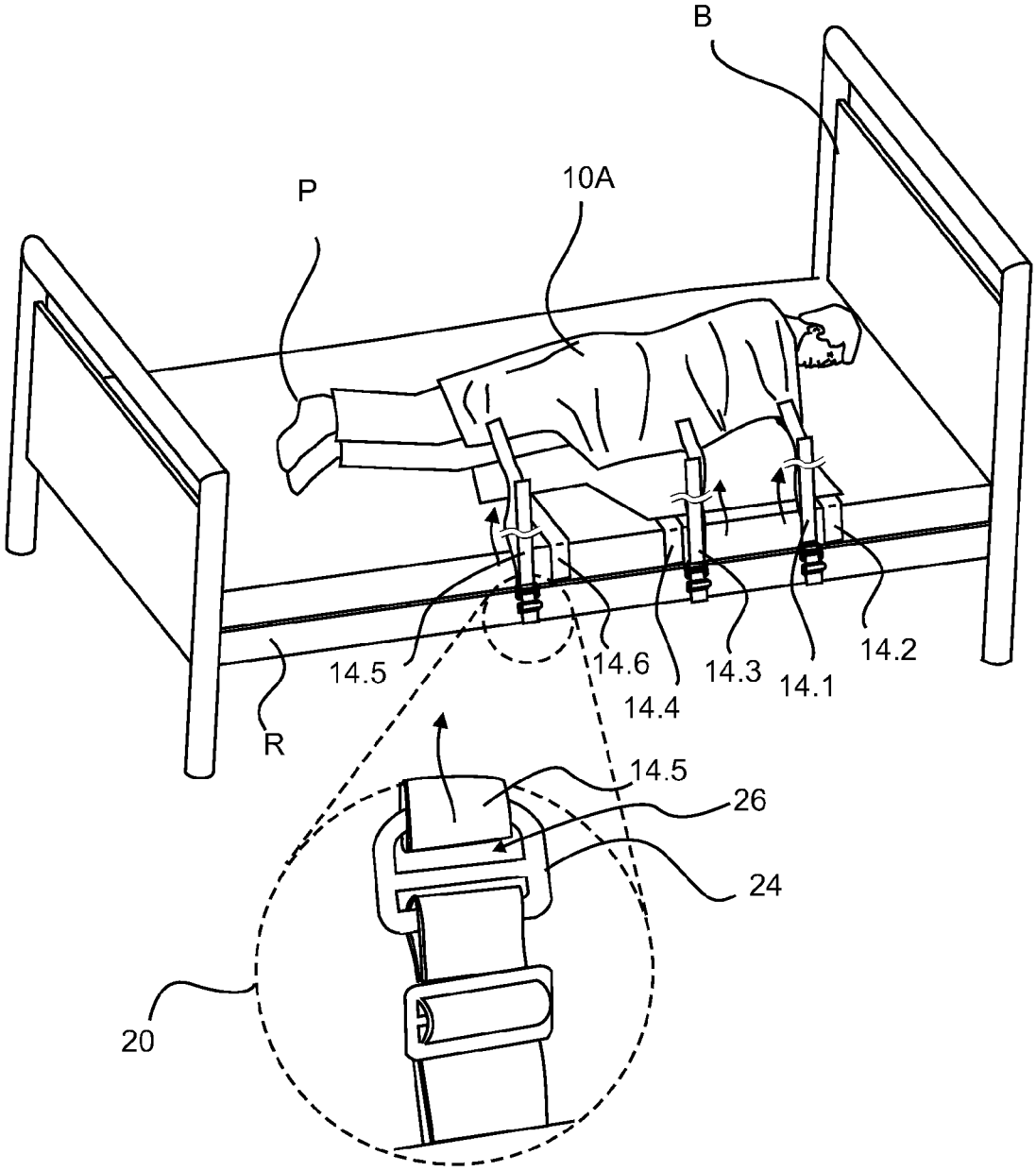
FIGS. 9A and 9B are perspective side views of body rotation and securing sling assembly of FIGS. 2 and 3 positioned under a patient lying on a bed wherein the patient, showing straps being fed through D rings affixed to the bed rail.
Figure 9B:
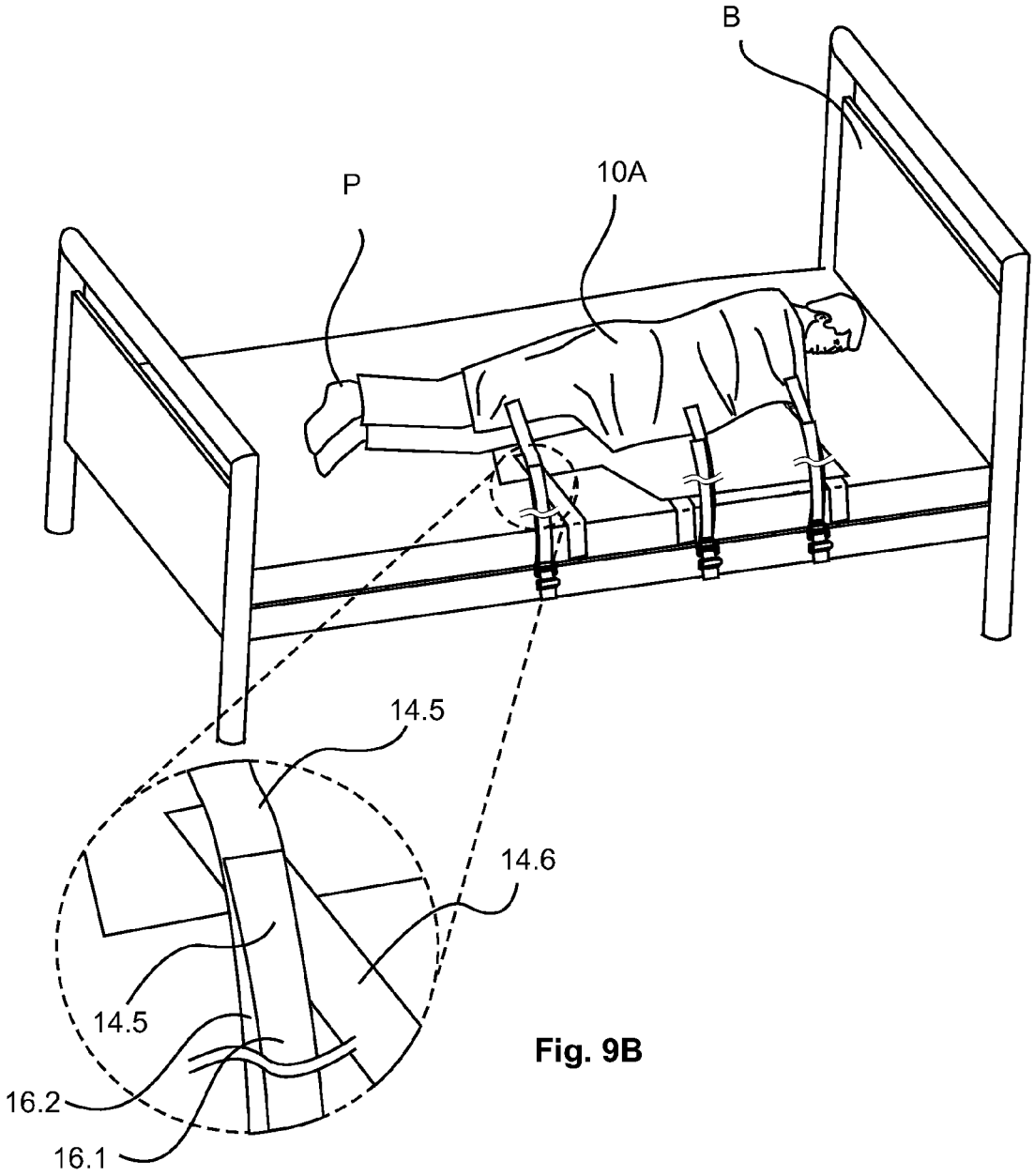
Figure 10:
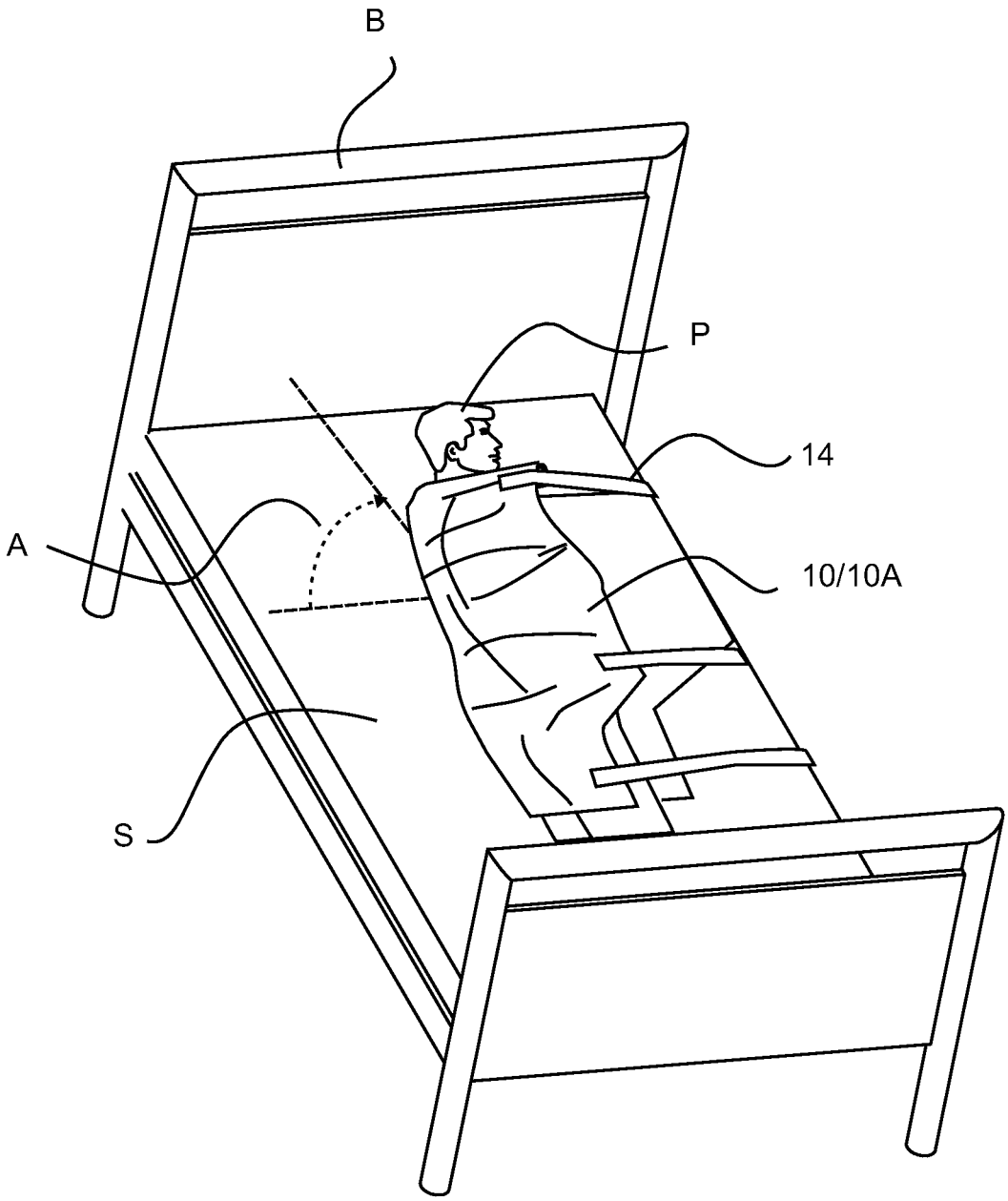
FIG. 10 is a top perspective view of body rotation and securing sling assembly of FIGS. 1 and 2 positioned under a patient lying on a bed wherein the patient is held in an angled position.
Figure 11:
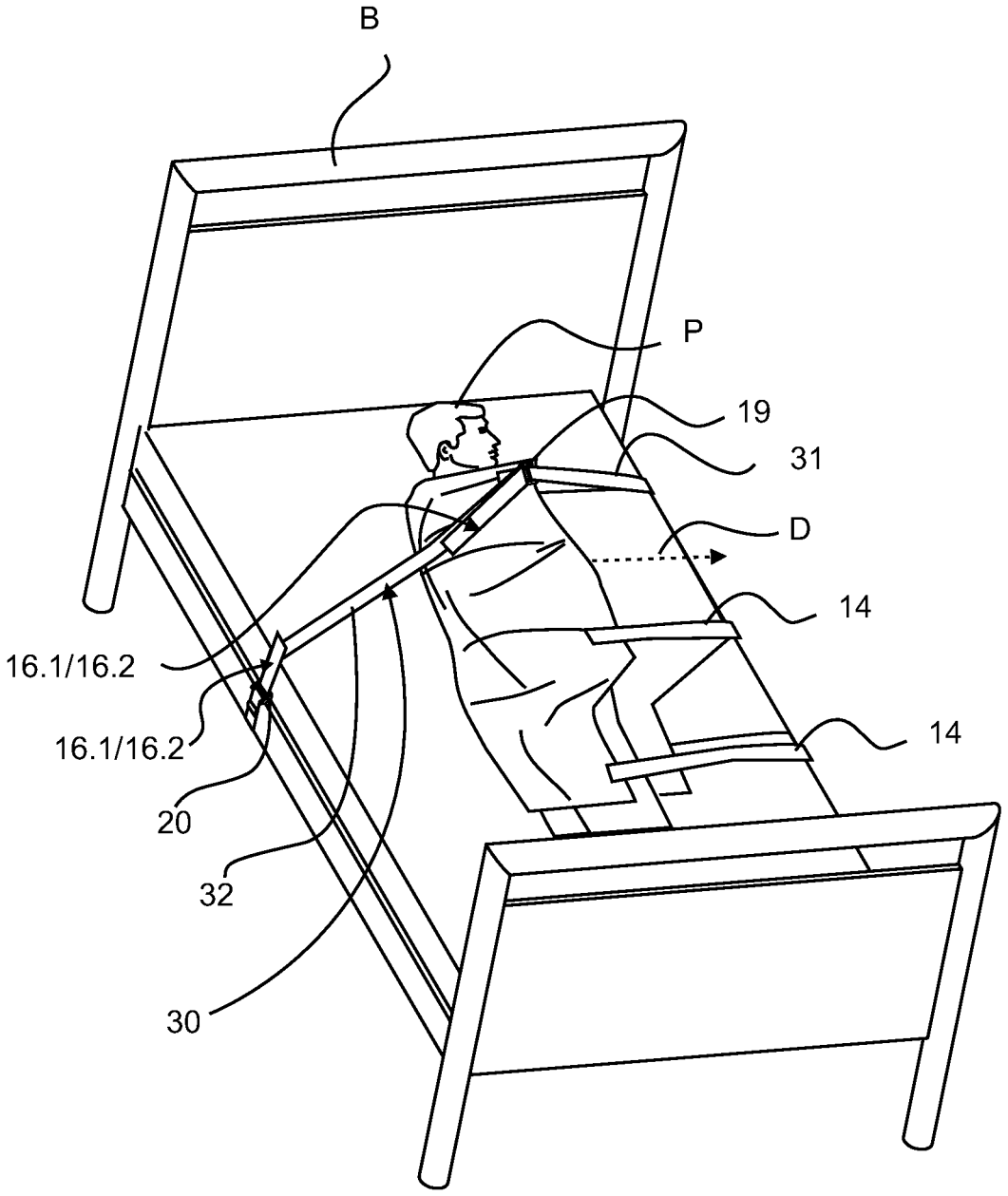
FIG. 11 is a top perspective view of body rotation and securing sling assembly of FIGS. 1 and 2 positioned under a patient lying on a bed wherein the patient is further tethered to prevent the patient from rolling or leaning forward.

Referring now to 9A and 9B, by way of example, and not limitation, there is illustrated views of sling assembly 10 positioned under patient P lying on a bed B with a portion of sling assembly 10 draped over patient P. Preferably, second torso strap 14.2, second hip strap 14.4, and/or second leg strap 14.6 may be fed under rail R of bed B and looped back up on to bed B. Next, first torso strap 14.1, first hip strap 14.3, and first leg strap 14.5 may be inserted through opening, hook or aperture 26 (structure that defines an opening, hole or aperture) of second D ring 24 of anchor strap 20 affixed thereto rail R of bed B (as shown in FIG. 3) and utilized to anchor or affix sling assembly 10 to one side of bed B. As shown in FIG. 9B, hook and loop sections of first torso strap 14.1, first hip strap 14.3, and first leg strap 14.5 are looped back on to itself and preferably utilized to cinch and secure (hook 16.1 and loop 16.2 releasably affixed together) patient P in a resting position on patient's side (left).

It is contemplated herein that sling assembly 10/10A enables a single service person SP to quickly and releasably secure a bed ridden patient P on either of the patient to maintain patient's P comfort, facilitate patient examination, and to prevent bed sores from forming.

It is further contemplated herein that sling assembly 10/10A may be utilized with existing beds B or bed frames.

Referring now to 10, by way of example, and not limitation, there is illustrated a top perspective view of sling assembly 10/10A positioned under patient P lying on a bed B with sling assembly 10/10A anchored to bed B. Preferably, sling assembly 10/10A is cinched and anchored or secured to bed B to releasably hold or prevent movement of patient P in a backward leaning, angled, or slanted position away from straps 14, such as acute angle A relative to the surface S of the bed B. In use, patient P is preferably positioned in a backward leaning acute angle A (relative to the surface S of the bed B) by sling assembly 10/10A anchored to bed B for the purpose of supporting a bed ridden patient in an angled position on their side (left side) to enable additional positions to rest in an effort to reduce bed sores and to increase comfort of the bed ridden patient.

Referring now to 11, by way of example, and not limitation, there is illustrated a top perspective view of sling assembly 10/10A positioned under patient P lying on a bed B with sling assembly 10/10A anchored to bed B. Preferably, sling assembly 10/10A includes additional strap, such as tether 30 configured to releasably secure patient P in bed B, especially to prevent patient P from rolling or leaning forward in direction D toward straps 14. Tether 30 preferably includes one or more strap sections, such as first strap section 31 and second strap section 32 having attachment device, such as hook 16.1 and loop 16.2, as shown in FIG. 2 positioned on each end of the one or more strap sections. Furthermore, buckle 19 may be positioned between first strap section 31 and second strap section 32 and utilized to adjust the slack out of tether 30 to releasably secure patient P in bed B, especially to prevent patient P from rolling or leaning forward toward or in the direction of straps 14.

Figure 12:
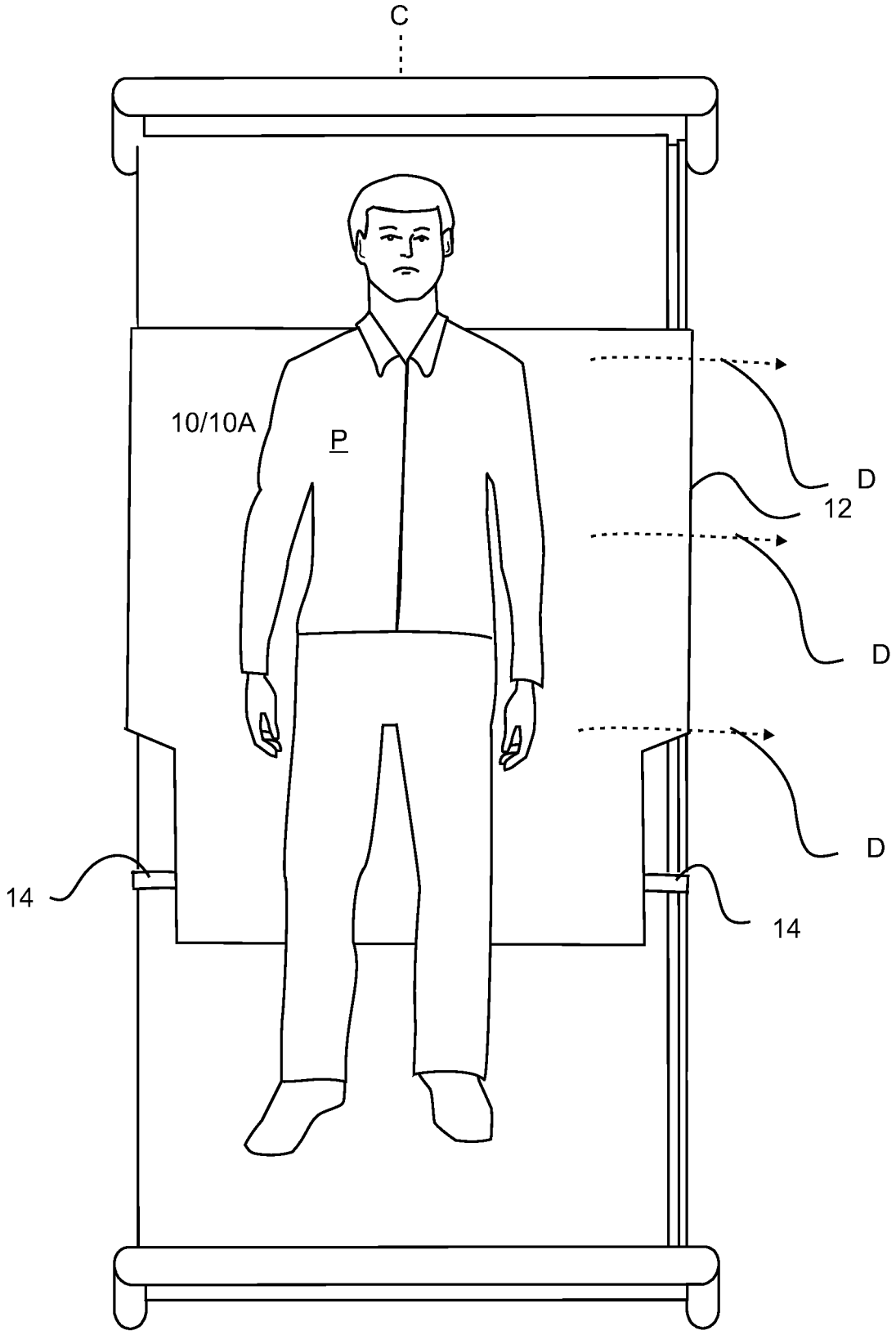
FIG. 12 is a top view of body rotation and securing sling assembly of FIGS. 1 and 2 positioned under a patient lying on a bed with the sling positioned on top of the bed between the patient and bed.

Referring now to FIG. 12, by way of example, and not limitation, there is illustrated an exemplary view of sling assembly 10/10A positioned under a patient P lying on bed B with sling assembly 10/10A positioned on top of bed B between the patient P and bed B. As shown in FIG. 12, patient P may be unstrapped and pulled or tugged to a position at rest and centered in bed B. Preferably edge 12 and/or straps 14 of sling assembly 10/10A may be utilized to drag, reposition, and/or move patient P around on bed B, in the direction D away from the center C line of bed B. As shown in FIG. 5, patient P may be drug or repositioned to one side (right of center C) of bed B by service person SP tugging or pulling on edge 12 and/or straps 14.

Figure 13:
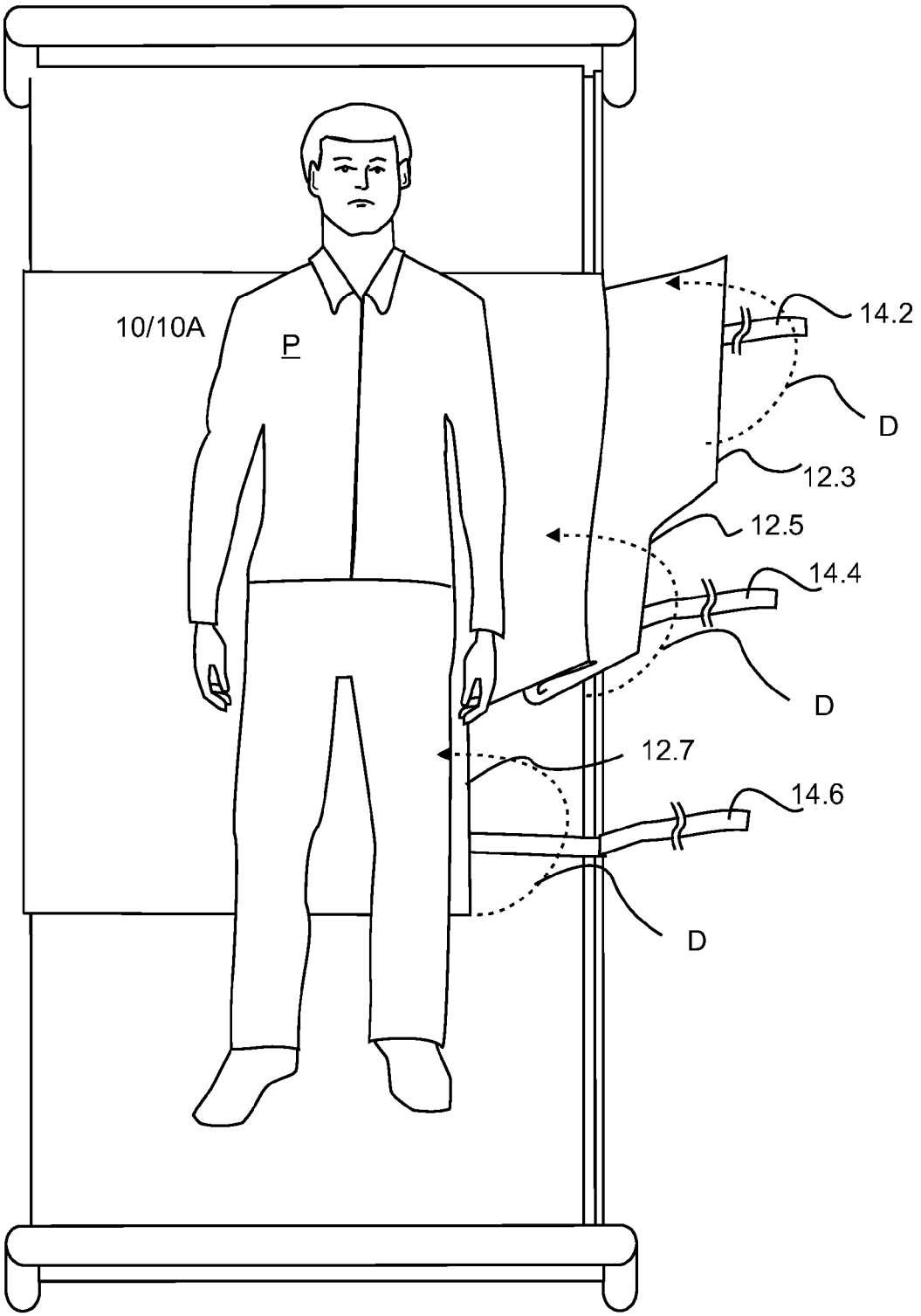
FIG. 13 is a top view of body rotation and securing sling assembly of FIGS. 1 and 2 positioned under a patient lying on a bed with a portion of the sling beginning to be draped over the patient.
Figure 14:
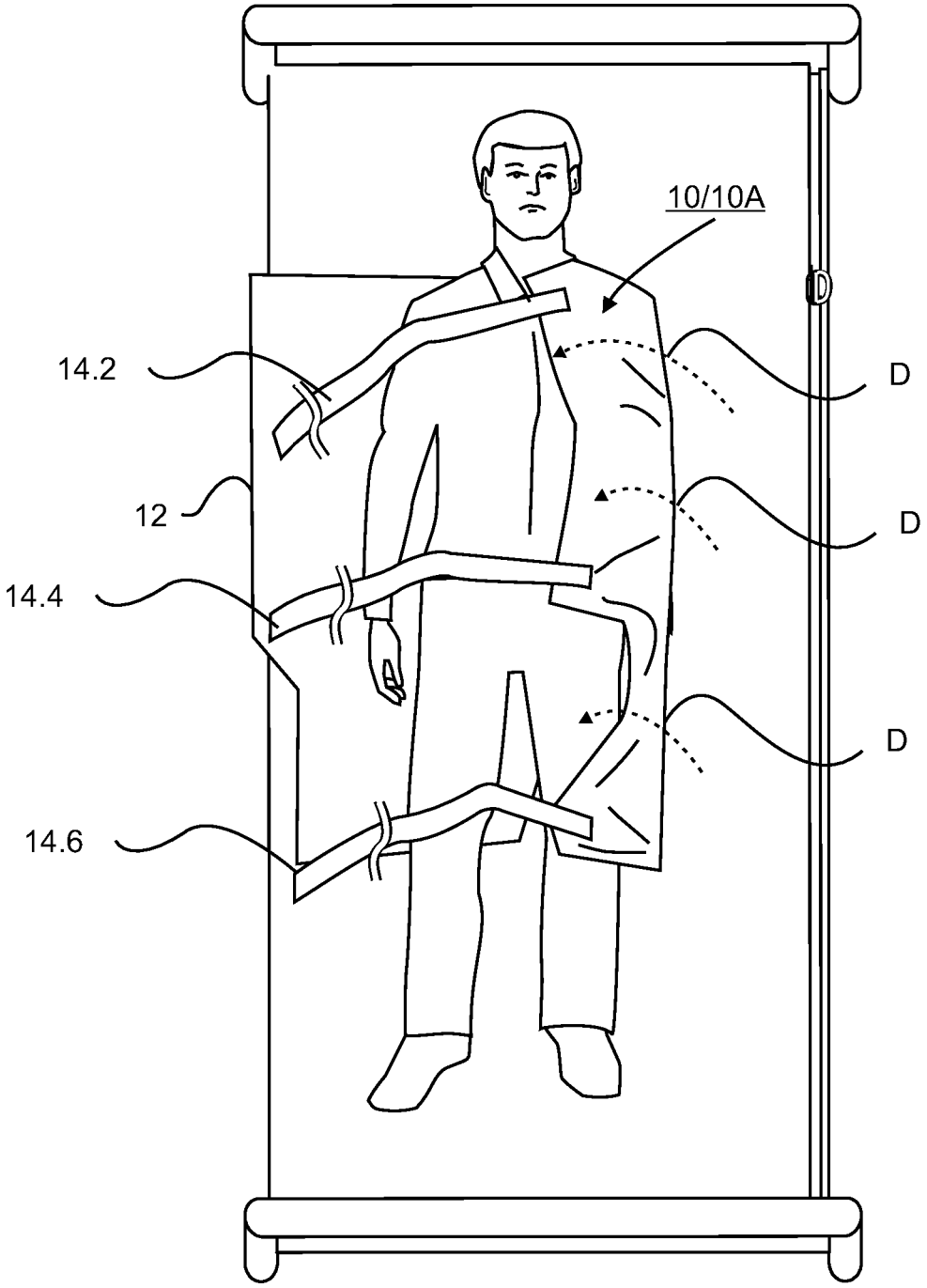
FIG. 14 is a top view of body rotation and securing sling assembly of FIGS. 1 and 2 positioned under a patient lying on a bed with a portion of the sling draped over the patient.
Figure 15:
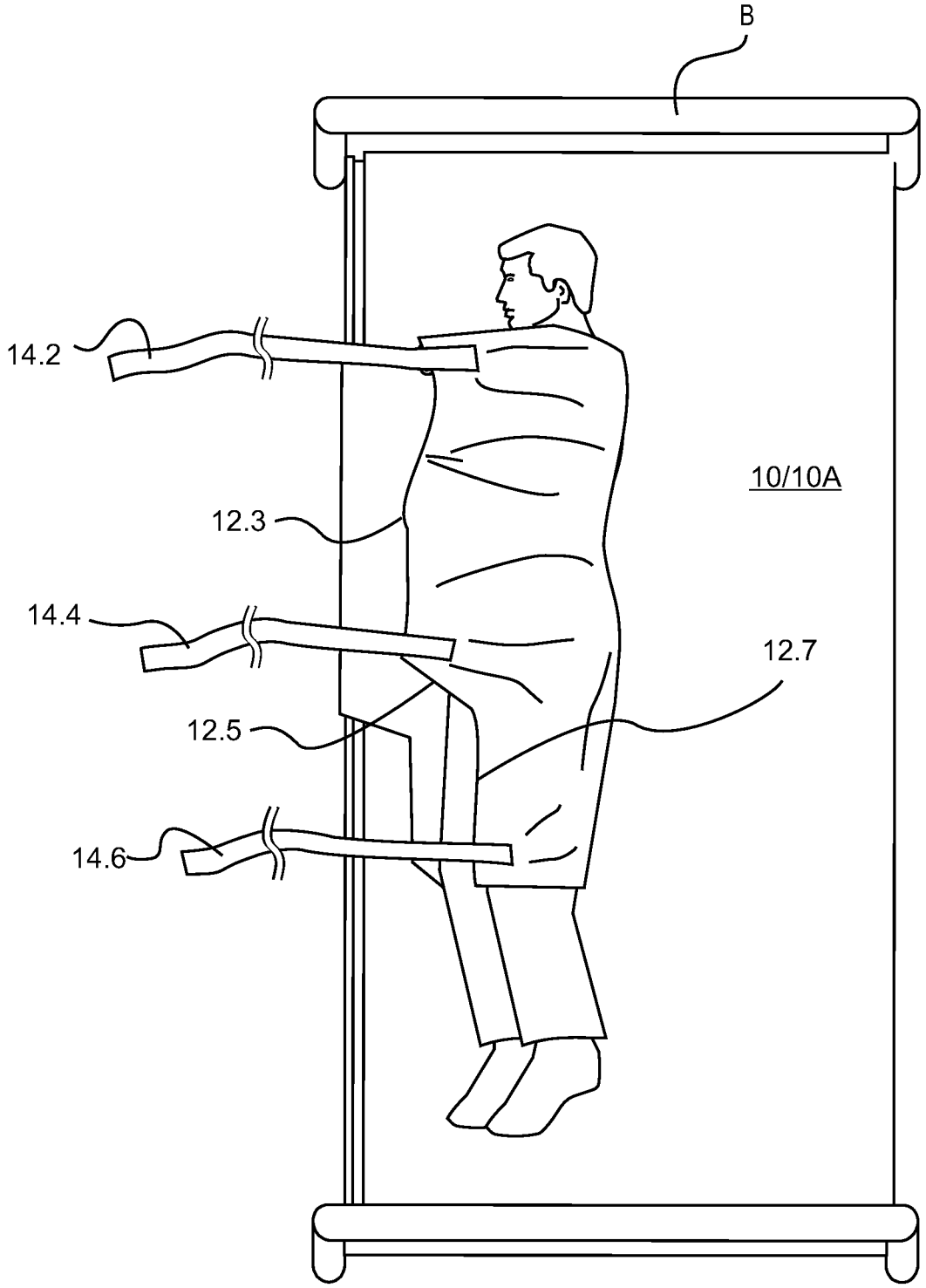
FIG. 15 is a top view of body rotation and securing sling assembly of FIGS. 1 and 2 positioned under a patient lying on a bed wherein the patient may be rolled or rotated in the direction D (shown in FIG. 14) to one side to a resting position on patient's right side.

Referring now to FIGS. 13, 14, and 15, by way of example, and not limitation, there is illustrated an exemplary view of sling assembly 10/10A positioned under patient P lying on a bed B with a portion of sling assembly 10/10A beginning to be draped over patient P. Preferably, second torso strap 14.2, second hip strap 14.4, and second leg strap 14.6; second torso edge 12.3, second hip edge 12.5, and second leg edge 12.7 are gathered and lifted on the right side of patient P. As shown in FIG. 14, second torso strap 14.2, second hip strap 14.4, and second leg strap 14.6 are preferably draped over back lying patient P with second torso strap 14.2, second hip strap 14.4, and/or second leg strap 14.6 being disposed proximate left edge 12 of sling assembly 10/10A. As shown in FIG. 15, patient P may be rolled or rotated in the direction D (shown in FIG. 14) to one side to a resting position on patient's side (right side) by service person SP tugging or pulling on edge 12 and/or straps 14, especially tugging or pulling on second torso strap 14.2, second hip strap 14.4, and/or second leg strap 14.6; and/or second torso edge 12.3, second hip edge 12.5, and second leg edge 12.7 of sling assembly 10/10A.

It is contemplated herein that sling assembly 10/10A preferably assist service person SP by providing straps 14 for the service person SP to roll, position, reposition, center, and tilt a bed ridden patient P from side-to-side, especially when the patient P is heavy.

It is further contemplated herein that sling assembly 10/10A shown in FIGS. 12-15 preferably may be utilized to releasably secure patient P in bed B in a resting position on patient's side (right) by coupling, attaching and/or affixing sling assembly 10/10A to rail R of bed B, as shown in FIGS. 8-11.

Figure 16A:
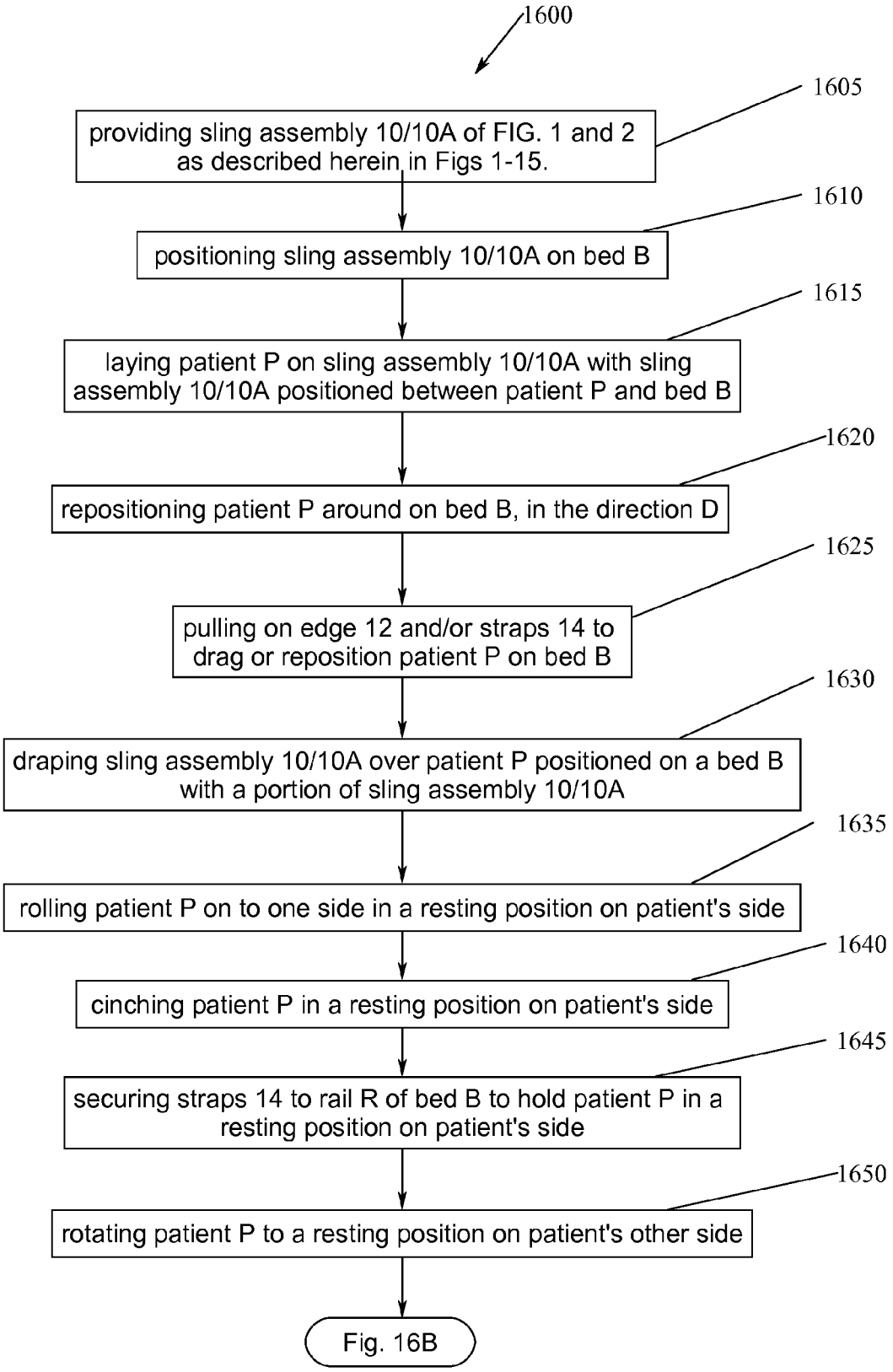
FIGS. 16A and 16B is a flow diagram of a method of marketing, positioning, dragging, rolling, securing, lifting, carrying, transporting, and maneuvering the bed ridden person utilizing sling assembly of FIGS. 1 and 2 around on the bed.
Figure 16B:
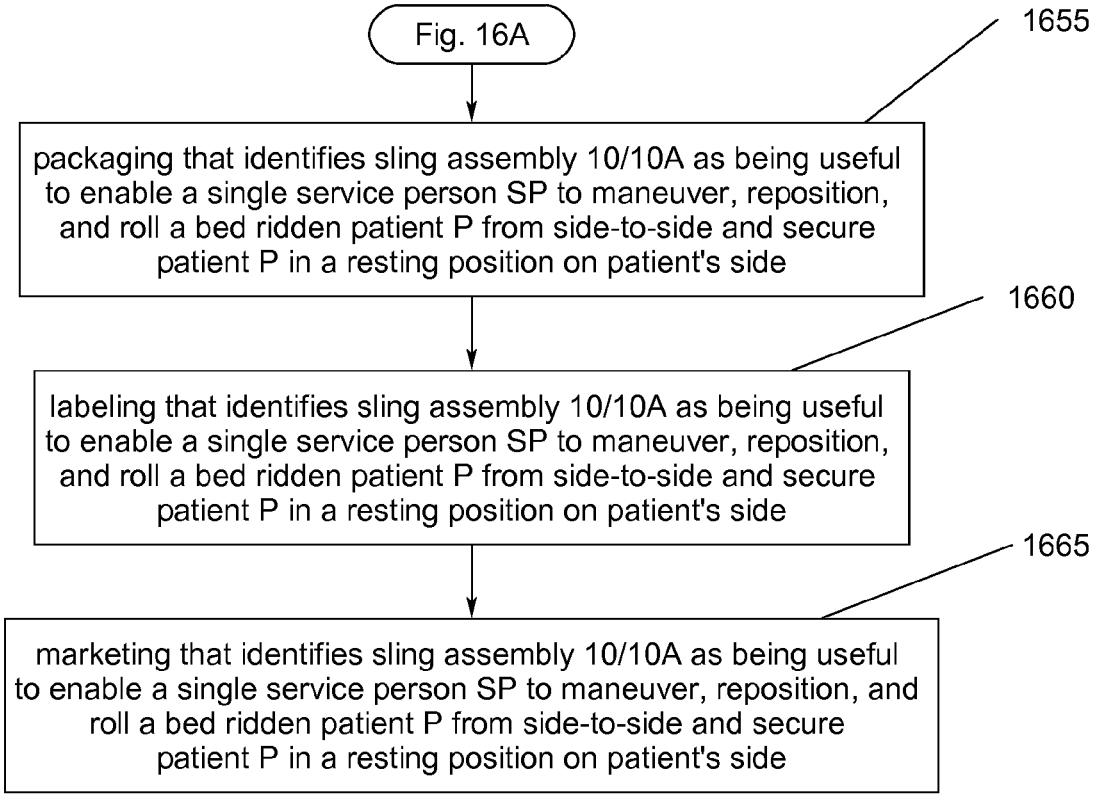

Referring now to FIG. 16, there is illustrated a flow diagram 1600 of a method of providing, marketing, positioning, dragging, rolling, securing, lifting, carrying, transporting, and maneuvering the bed ridden patient P utilizing sling assembly 10/10A of FIGS. 1 and 2 around on bed B as described herein in FIGS. 1-15. In block or step 1605, providing sling assembly 10/10A of FIGS. 1 and 2 as described herein in FIGS. 1-15. In block or step 1610, positioning sling assembly 10/10A on bed B. In block or step 1615, laying patient P on sling assembly 10/10A with sling assembly 10/10A positioned between patient P and bed B. In block or step 1620, repositioning patient P around on bed B, in the direction D. In block or step 1625, pulling on edge 12 and/or straps 14 to drag or reposition patient P on bed B. In block or step 1630, draping a portion of sling assembly 10/10A over patient P positioned on a bed B. In block or step 1635, rolling or rotating patient P on to one side in a resting position on patient's side. In block or step 1640, releasably cinching patient P in a resting position on patient's side. In block or step 1645, securing straps 14 to rail R of bed B to releasably hold or prevent movement of patient P in a resting position on patient's side. In block or step 1650, rotating patient P to a resting position on patient's other side. In block or step 1655, packaging to identify sling assembly 10/10A as being useful to enable a single service person SP to maneuver, reposition (ing), and roll a bed ridden patient P from side-to-side and releasably secure patient P in a resting position on patient's side. In block or step 1660, labeling to identify sling assembly 10/10A as being useful to enable a single service person SP to maneuver, reposition, and roll a bed ridden patient P from side-to-side and releasably secure patient P in a resting position on patient's side. In block or step 1665, marketing to identify sling assembly 10/10A as being useful to enable a single service person SP to maneuver, reposition, and roll a bed ridden patient P from side-to-side and releasably secure patient P in a resting position on patient's side.

The foregoing description and drawings comprise illustrative embodiments of the present invention. Having thus described exemplary embodiments, it should be noted by those ordinarily skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one ordinarily skilled in the art to which this invention pertains having the benefit of the teachings presented in the foregoing descriptions and the associated drawings. Although specific terms may be employed herein, they are used in a generic and descriptive sense only and not for purposes of limitation. Moreover, the present invention has been described in detail; it should be understood that various changes, substitutions and alterations can be made thereto without departing from the spirit and scope of the invention as defined by the appended claims. Accordingly, the present invention is not limited to the specific embodiments illustrated herein, but is limited only by the following claims.

What is claimed is:

1. An apparatus for rotating and securing a side laying person on a bed having a frame below the surface of a mattress, the apparatus comprising:

a contoured sheet haying a first side and a second side configured with a plurality of edges on each side dimensioned to conform to-the side laying person's back, torso, hips and upper legs;

a plurality of straps on each side of the contoured sheet having a first end and a second end, said plurality of straps configured with said second end of each of said plurality of straps affixed thereto an edge of said plurality of edges on each side of the contoured sheet; and wherein said first end of each of said plurality of straps is configured having an attachment mechanism for releasably securing said first end to the frame of the bed below the surface of the mattress;

whereby:

when said contoured sheet is in a first flat configuration, each of said attachment mechanisms on each side of the contoured sheet being releasably securable to the corresponding side of the frame, and when said contoured sheet is in a second folded configuration, each of said attachment mechanisms being releasably securable to the same side of the frame thereby securing the side laying person's back, torso, hips and upper legs.

2. The apparatus of claim 1, said plurality of edges includes a first torso edge and a second torso edge, a first hip edge and a second hip edge, and a first leg edge and a second leg edge, wherein said first hip edge is configured having a first angled transition between said first torso edge and said first leg edge, and wherein said second hip edge is configured having a second angled transition between said second torso edge and said second leg edge;

wherein, said first hip edge and second hip edge are angled, curved, tapered, arced, or slanted relative to said first torso edge and said first leg edge and second torso edge and second leg edge , respectively, to accommodate the difference in size and/or volume between the side laving person's torso, hips and upper legs .

3. The apparatus of claim 2, said plurality of straps includes a first torso strap affixed to said first torso edge, a second torso strap affixed to said second torso edge, a first hip strap affixed to said first hip edge, a second hip strap affixed to said second hip edge, a first leg strap affixed to said first leg edge, and a second leg strap affixed to said second leg edge.

4. The apparatus of claim 2, wherein said first torso edge is configured parallel to said first leg edge and said second torso edge is configured parallel to said second leg edge.

5. The apparatus of claim 1, wherein said attachment mechanism further comprises hook and loop.

6. The apparatus of claim 5, wherein said attachment mechanism is configured to loop around the frame of the bed to releasably secure the side laying person on the bed.

7. The apparatus of claim 6, wherein said plurality of straps further comprises a buckle for length adjustment of one or more straps of said plurality of straps.

8. The apparatus of claim 7, wherein said attachment mechanism further comprises an attachment ring affixed to one or more straps of said plurality of straps.

9. The apparatus of claim 8, wherein said attachment mechanism is configured to releasably secure the side laying person on the bed.

10. The apparatus of claim 2, wherein said contoured sheet is configured to wrap around the side laying person.

11. The apparatus of claim 3, wherein said plurality of straps are configured to enable repositioning of the side laying person on the bed.

12. The apparatus of claim 5, wherein said apparatus further comprises an anchor strap configured to loop around the frame of the bed to create an anchor to affix one or more straps of said plurality of straps thereto said anchor strap;

whereby, when said contoured sheet is in said second folded configuration and each of said attachment mechanisms is releasably secured to the same side of the frame, said anchor being releasably securable to the opposite side of the bed for further securing the side laying person.

13. The apparatus of claim 12 wherein said anchor strap further comprises an attachment ring.

14. The apparatus of claim 13, wherein said anchor strap further comprises a buckle for length adjustment of said anchor strap to cinch thereto the rail.

15. The apparatus of claim 6, wherein said attachment mechanism is configured to releasably secure the side laying person on the bed in an angled position.

16. A method of positioning, rolling, and securing a side laying person on a bed having a frame below the surface of a mattress, said method comprising the steps of:

providing a body rotation and securing apparatus, said apparatus having a contoured sheet having a left side and a right side configured with a plurality of edges on each side dimensioned to conform to the side laying person, a plurality of straps on each side of the contoured sheet having a first end and a second end, said plurality of straps configured with said second end of each of said plurality of straps affixed thereto an edge of said plurality of edges on each side of the contoured sheet, wherein said first end of each of said plurality of straps is configured having an attachment mechanism thereon for releasably securing said first end to the frame of the bed below the surface of the mattress, whereby:

when said contoured sheet is in a first flat configuration, each of said attachment mechanisms on each side of the contoured sheet being releasably securable to the corresponding side of the frame, and when said contoured sheet is in a second folded configuration, each of said attachment mechanisms being releasably securable to the same side of the frame thereby securing the side laving person;

positioning said apparatus on the bed;

laying the person on said apparatus with said apparatus positioned between the person and the bed; and pulling on said plurality of straps to reposition the person on the bed.

17. The method of claim 16, further comprising the step of draping a portion of said apparatus over the person.

18. The method of claim 17, further comprising the step of rotating the person on a side in a resting position.

19. The method of claim 18, further comprising the step of securing said plurality of straps to the frame of the bed to releasably hold the person in said resting position on person's side.

20. The method of claim 19, further comprising the step of packaging the apparatus to identify the apparatus as being useful to enable repositioning of the person on the bed and to releasably secure the person in said resting position on the person's side.

21. The method of claim 19, further comprising the step of labeling the apparatus to identify the apparatus as being useful to enable repositioning of the person on the bed and to releasably secure the person in said resting position on the person's side.

22. The method of claim 19, further comprising the step of marketing the apparatus to identify the apparatus as being useful to enable repositioning of the person on the bed and to releasably secure the person in said resting position on the person's side.

* * * * *